US012577751B2

(12) United States Patent
Kaldor et al.

(10) Patent No.: US 12,577,751 B2
(45) Date of Patent: Mar. 17, 2026

(54) FORCE-BASED CONTROL OF ELECTRICALLY ACTUATED POWER MACHINES

(71) Applicant: Doosan Bobcat North America, Inc., West Fargo, ND (US)

(72) Inventors: Matthew Kaldor, Bismarck, ND (US); Charles Young, Bismarck, ND (US); Jeff Dahl, Bismark, ND (US)

(73) Assignee: Doosan Bobcat North America, Inc., West Fargo, ND (US)

( * ) Notice: Subject to any disclaimer, the term of this patent is extended or adjusted under 35 U.S.C. 154(b) by 0 days.

(21) Appl. No.: 19/044,215

(22) Filed: Feb. 3, 2025

(65) Prior Publication Data

US 2025/0250765 A1 Aug. 7, 2025

Related U.S. Application Data

(60) Provisional application No. 63/549,212, filed on Feb. 2, 2024.

(51) Int. Cl.
*E02F 3/43* (2006.01)

(52) U.S. Cl.
CPC ..... *E02F 3/43* (2013.01)

(58) Field of Classification Search
CPC ..... E02F 3/43; E02F 3/42; E02F 3/36; E02F 3/28; E02F 3/04; E02F 9/2203; E02F 9/207; E02F 9/2062; E02F 9/2058
See application file for complete search history.

(56) References Cited

U.S. PATENT DOCUMENTS

2007/0073465 A1 3/2007 Brown et al.
2007/0131438 A1* 6/2007 Brandt ..... E02F 9/2203 172/464
2018/0043898 A1* 2/2018 Andersson ..... E02F 9/207
2018/0072281 A1 3/2018 Bruyere et al.

FOREIGN PATENT DOCUMENTS

WO 2023141563 A1 7/2023

OTHER PUBLICATIONS

International Searching Authority—EPO, International Search Report and Written Opinion received for corresponding International Patent App. No. PCT/US2025/014318, mailed May 28, 2025 [12 pgs.].

* cited by examiner

*Primary Examiner* — Erin M Piateski
*Assistant Examiner* — Ashley Tiffany Schoech
(74) *Attorney, Agent, or Firm* — Quarles & Brady LLP

(57) ABSTRACT

Port-relief emulation for electrically actuated power machines. One system may include one or more electronic processors in electrical communication with an electric actuator of the electric power machine. The one or more electronic processors may be configured to receive data for an electric power machine while the electric power machine is performing an operation and determine, based on the data, a force on an electric actuator of the electric power machine. The one or more electronic processors may be configured to, responsive to the force exceeding a threshold, control the electric actuator or another electric actuator of the electric power machine to enforce a force limit.

19 Claims, 8 Drawing Sheets

FORCE-BASED CONTROL OF ELECTRICALLY ACTUATED POWER MACHINES

CROSS-REFERENCE TO RELATED APPLICATIONS

This application claims priority to U.S. Provisional Application No. 63/549,212, filed Feb. 2, 2024, the entire contents of which is incorporated herein by reference.

BACKGROUND

This disclosure is directed toward power machines. More particularly, this disclosure is directed to excavators and control of work operations for excavators.

Power machines, for the purposes of this disclosure, include any type of machine that generates power to accomplish a particular task or a variety of tasks. One type of power machine is a work vehicle. Work vehicles are generally self-propelled vehicles that have a work device, such as a lift arm (although some work vehicles can have other work devices) that can be manipulated to perform a work function. Work vehicles include excavators, loaders, utility vehicles, tractors, trenchers, and telescopic handlers to name a few examples. Other examples of power machines include telescopic handlers (or telehandlers), loaders, and articulated vehicles.

Excavators are a known type of power machine that generally include an undercarriage and a house that selectively rotates on the undercarriage. A lift arm to which an implement can be attached is operably coupled to, and moveable under power with respect to, the house. Excavators are typically self-propelled vehicles.

Typical excavators include one or more operator input devices (e.g., joysticks or pedals) that are physically moved by an operator to directly adjust hydraulic fluid flow to or through a particular component of the excavator (e.g., a control valve for an actuator for a lift arm), as can control the movement of the particular component (e.g., the lift arm). For example, a joystick can be physically coupled to a hydraulic valve either through mechanical cables or linkages between the joystick and a hydraulic control valve for various actuators, or through pilot hydraulic signals that are controlled by the joystick (i.e., the use of what is commonly known as pilot operated joysticks). Accordingly, movement of the joystick can directly or indirectly change the hydraulic valve position and thereby control movement of an actuator and a component that is coupled to the actuator.

The discussion above is merely provided for general background information and is not intended to be used as an aid in determining the scope of the claimed subject matter.

SUMMARY OF THE DISCLOSURE

On compact excavators (and other power machines), the source of an external load on an actuator is often an application of force by another actuator in the system. For example, when an excavator is digging below grade and the arm cylinder is actuated fill the bucket, the horizontal reaction force from the ground can create a tensile force on the boom cylinder.

Hydraulic systems typically have port relief valves (or port reliefs) connected in parallel with actuators, which can protect the hydraulic system and structures from over-pressurization and over-stress caused by external loads. For example, if the load noted above induces a pressure in the rod side of the boom cylinder that exceeds the pressure setting of the port relief, the relief valve opens and flow escapes from the rod side of the boom. In this way, the relief valve limits the forces and stresses in the structure and prevents over pressurization of the hydraulic system until either the operator stops generating force with the arm cylinder or the relative orientation of the boom and arm changes such that the force in the boom cylinder is reduced.

Electric actuators can exhibit significant strength, including as could result in deformation or other damage to actuators or other lift arm structures in some applications. Accordingly, there is a need to control operation of these actuators to accommodate the many possibilities for commanded movement of workgroups (e.g., excavator lift arms), without inducing excessive loads on particular actuators or structures.

Implementations of the disclosed technology can address these issues, among others, to provide improved operation of electrically powered power machines—and electrically powered lift arms, in particular. For example, some implementations can emulate the effects of port relief valves, as discussed above, but for electric power machines (e.g., in which hydraulic cylinders of conventional arrangements are replaced with electric linear actuators). In some examples, the approaches disclosed herein can thus help to protect actuators and other structures of the power machine, as well as to maintain an operator "feel" that is beneficially similar to a conventional hydraulic power machine.

Some configurations described herein provide a control system of an electric power machine. The control system may include one or more electronic processors in electrical communication with a plurality of electric actuators of the electric power machine. The one or more electronic processors may be configured to control a first electric actuator of the plurality of electric actuators to perform an operation according to a set of operator commands. The one or more electronic processors may be configured to receive data for the electric power machine while the electric power machine is performing the operation. The one or more electronic processors may be configured to determine, based on the data, a present electric current of a second electric actuator of the plurality of electric actuators. The one or more electronic processors may be configured to detect, based on the present electric current, when a force on the second electric actuator exceeds a threshold. The one or more electronic processors may also be configured to, responsive to the force exceeding the threshold, control the first electric actuator or the second electric actuator to reduce the force on the second electric actuator resulting from the first electric actuator performing the operation.

Some configurations described herein provide a method for controlling an electric power machine. The method may include receiving, with one or more electronic processors in electrical communication with electric actuators of the electric power machine, data for the electric power machine while the electric power machine is operating. The method may include determining, with the one or more electronic processors, based on the data, a force on a first electric actuator of the electric actuators, the force corresponding to a present or commanded operation with at least one of the electric actuators. The method may include determining, with the one or more electronic processors, when the force exceeds a force threshold. The method may include, responsive to the force exceeding the force threshold, controlling, with the one or more electronic processors, one or more of the electric actuators to provide an updated force on the first electric actuator that does not exceed the force threshold.

Some configurations described herein provide a system for controlling an electric power machine. The system may include one or more electronic processors in electrical communication with an electric actuator of the electric power machine. The one or more electronic processors may be configured to receive data for the electric power machine while the electric power machine is performing an operation. The one or more electronic processors may be configured to determine, based on the data, a force on the electric actuator of the electric power machine. The one or more electronic processors may be configured to determine when the force exceeds a force threshold. The one or more electronic processors may be configured to, responsive to the determined force exceeding the force threshold, control at least one of the electric actuator or another electric actuator of the electric power machine to provide an updated force on the electric actuator that does not exceed the force threshold.

This Summary and the Abstract are provided to introduce a selection of concepts in a simplified form that are further described below in the Detailed Description. The Summary and the Abstract are not intended to identify key features or essential features of the claimed subject matter, nor are they intended to be used as an aid in determining the scope of the claimed subject matter.

BRIEF DESCRIPTION OF THE DRAWINGS

The following drawings are provided to help illustrate various features of examples of the disclosure and are not intended to limit the scope of the disclosure or exclude alternative implementations.

DETAILED DESCRIPTION OF THE PRESENT DISCLOSURE

Figure 1:
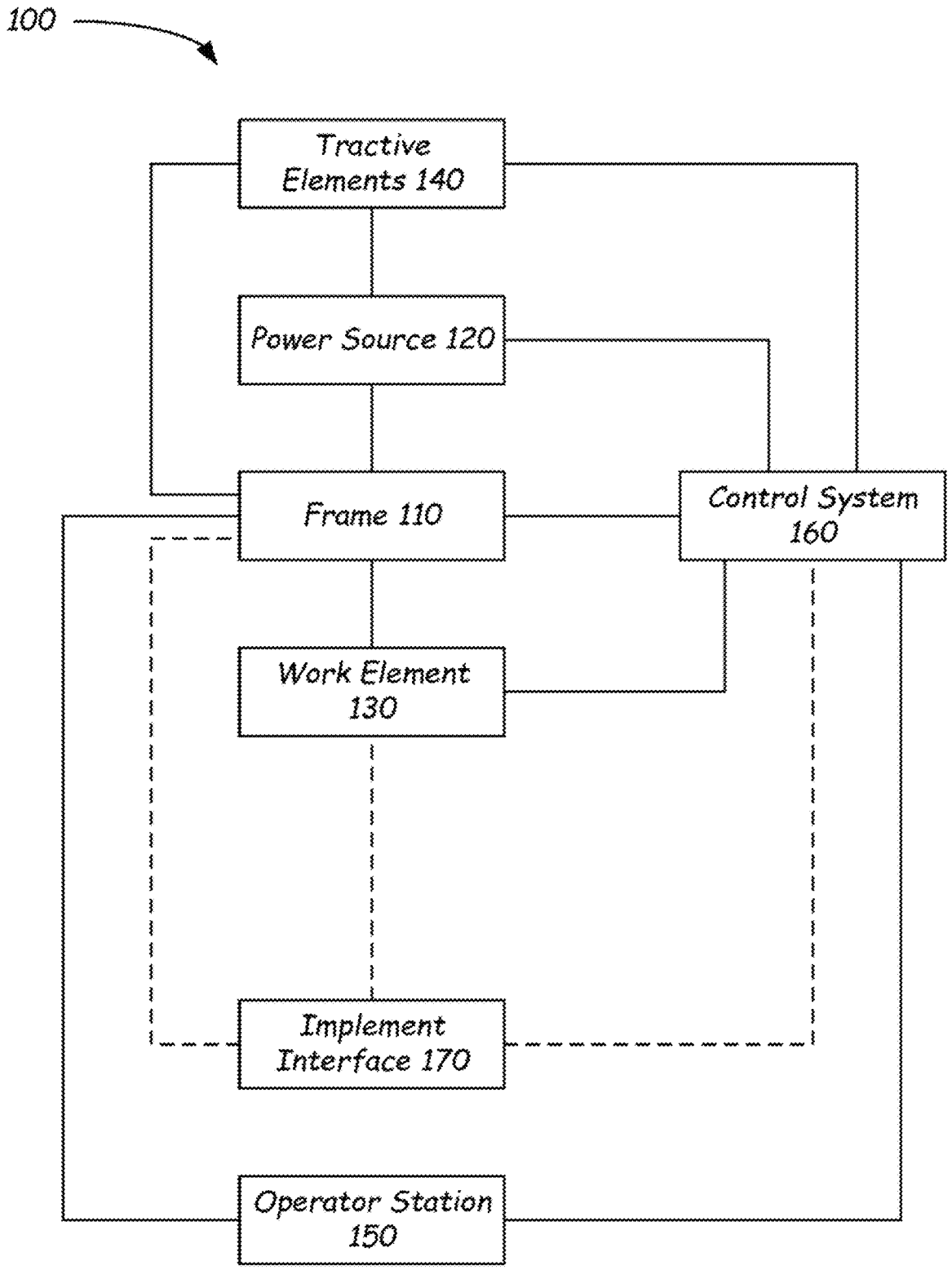
FIG. 1 is a block diagram illustrating functional systems of a representative power machine in accordance with some configurations.

The concepts disclosed in this discussion are described and illustrated by referring to exemplary configurations. These concepts, however, are not limited in their application to the details of construction and the arrangement of components in the illustrative configurations and are capable of being practiced or being carried out in various other ways. The terminology in this document is used for the purpose of description and should not be regarded as limiting. Words such as "including," "comprising," and "having" and variations thereof as used herein are meant to encompass the items listed thereafter, equivalents thereof, as well as additional items.

As generally noted above, power machines can be configured for various work operations. For example, power systems of wheeled and tracked power machines can be configured to power tractive systems for wheeled, tracked, skid-steer, or other movement over terrain, and to power workgroup systems for various (non-tractive) workgroup operations, with articulated, extendable, or otherwise configured lift arms.

As noted above, it may be beneficial to manage the loading of particular electric actuators, including to avoid damage or other adverse effects of loads that are induced by operation of other electric actuators (e.g., on an excavator lift arm). As further detailed below, such management can generally be implemented by emulating hydraulic port relief valves, but for electric actuators of electric power machines (e.g., with conventionally arranged hydraulic cylinders replaced with electric linear actuators). Accordingly, the technology disclosed herein can help to protect the actuators and other structures of electrically powered power machine. Further, port relief emulation can help to provide a similar "feel" as a conventional hydraulic power machine, as may be appreciated by experience operators.

Generally, implementations of the disclosed technology can monitor and mitigate force on an actuator in various ways. In some examples, the electrical current flow for particular workgroup actuators can be monitored to determine local torque and known geometric relationships for the workgroup can then be used to determine corresponding forces relative to compression or tension of an extender (e.g., one or more ball screws of the monitored actuator(s)). In some examples, a first (e.g., tilt) actuator can be controlled to complete a work operation and force can be monitored for a second (e.g., lift) actuator that may experience induced forces due to operation of the first actuator. The first or second actuator can then be controlled, as appropriate, to prevent forces on the second actuator from exceeding a threshold (e.g., predetermined absolute maximum force). In this regard, in some instances, the disclosed technology may actively control a first (monitored) actuator when other actuators in the workgroup are in operator-commanded motion and a threshold electric current to maintain position at a first actuator has been exceeded.

For some electric actuators (e.g., self-locking actuators), the technology disclosed herein may monitor the external force on the electric actuator and command motion in the direction of the applied force when the force meets a predetermined threshold. In some instances, the velocity may be controlled via closed-loop feedback to maintain the threshold force. For actuators with brakes (e.g., high efficiency actuators with brakes), the technology disclosed herein may monitor the external force on the electric actuator (e.g., indirectly, via calculation of induced forces based on operation of other actuators and known lift arm geometry). When the force meets the threshold, the brake may be released and an opposing force commended (e.g., equal to the threshold force, so that external forces exceeding the threshold can move the actuator). When a high efficiency actuator is implemented, the high efficiency actuator may tend to extend on its own without being commanded. For example, in some instances, as a pitch of a worm gear or screw of a linear actuator increases, an efficiency may increase, and a self-lock ability may decrease. As pitch is decreased, efficiency may be lost with the gain of friction to self-lock.

In contrast, conventional control schemes of electric actuators (e.g., ball-screw actuators) may maintain a commanded actuator position up to a rated electric current limit of the actuator. During some practical operations (e.g., driving a loader into a spoil pile), this can result in large force events that can damage the actuators, or supporting structures (e.g., of a lift arm). In this regard, electrically emulating the port relief of traditional hydraulic power machines can help to prevent damage to electric actuators and other adverse effects.

Further, for excavator applications in particular, much of the force exerted on actuators of the lift arm workgroup may be responsive to the operator-commanded actuation of one or more other actuators. Accordingly, appropriately managing the possible forces may require relatively complicated conventional electrical control systems. Through the described monitoring and force adjustment, the technology disclosed herein may still allow for a variety of complex operations with excavator lift arms, while also ensuring appropriate mitigation of excess forces.

In one example, the technology disclosed herein may monitor an electric actuator and be responsive to data relating to a hold command for the electric actuator. The technology disclosed herein may correspondingly implement a force control scheme (e.g., port relief emulation) for the electric actuator when an electric current required to maintain commanded position exceeds a threshold.

As another example, the technology disclosed herein may set a force threshold for a given electric actuator based on sensed workgroup position. For example, different force thresholds may be set for particular actuators corresponding to different lift arm orientations (e.g., corresponding to different mechanical advantages of one or more actuators relative to movement of an implement). Upon exceeding the force threshold, the technology disclosed herein may implement a force control scheme that allows or actively causes movement to at least partially alleviate the force.

As yet another example, the technology disclosed herein may set a dynamic force threshold for a given actuator based on relevant operator inputs. For example, responsive to certain operator inputs that exceed the dynamic force threshold, the technology disclosed herein may temporarily increase the dynamic force threshold in order to allow the operator to complete a work task or operation.

Figure 2:
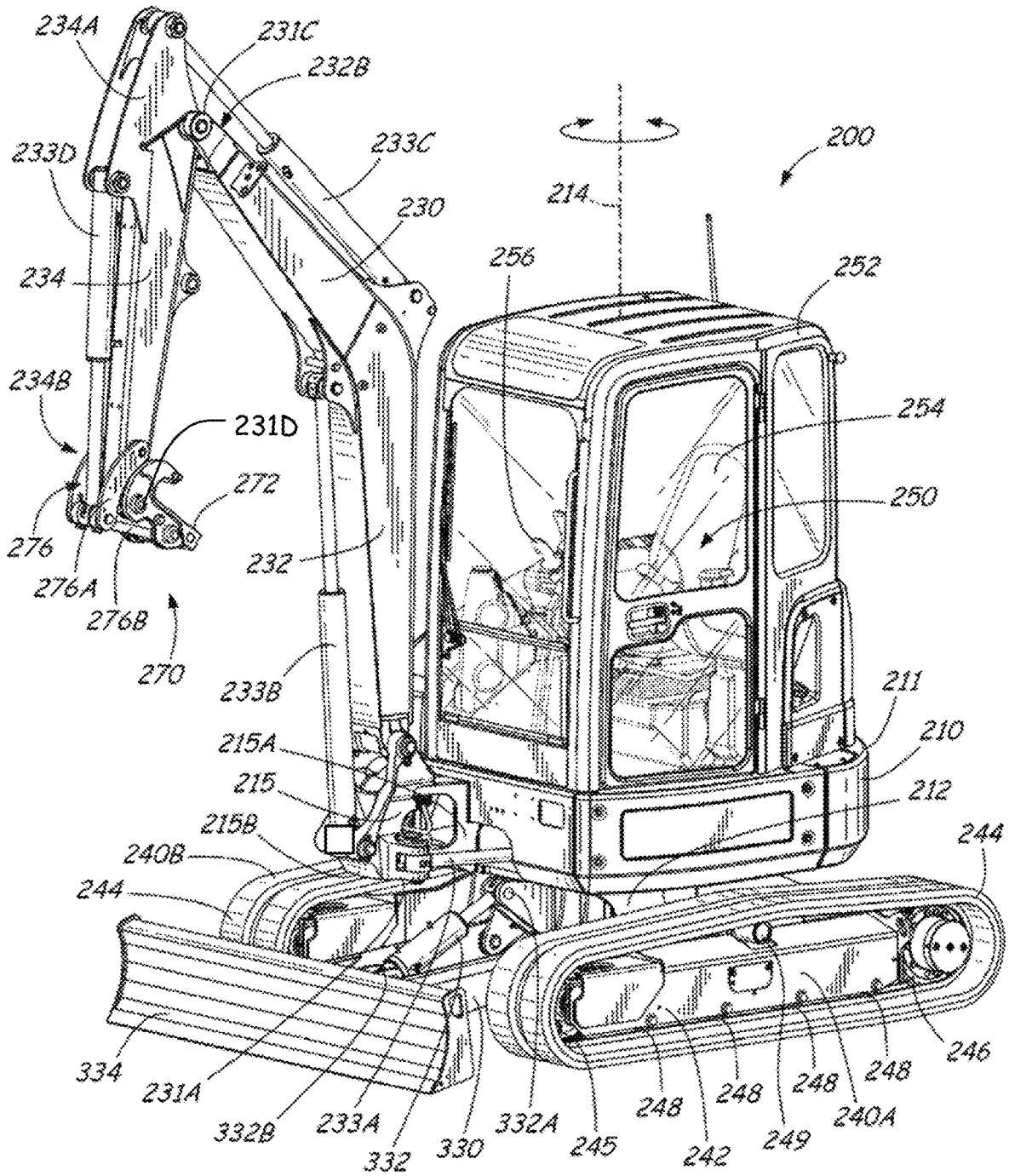
FIG. 2 is a front left perspective view of a representative power machine in the form of an excavator in accordance with some configurations.
Figure 3:
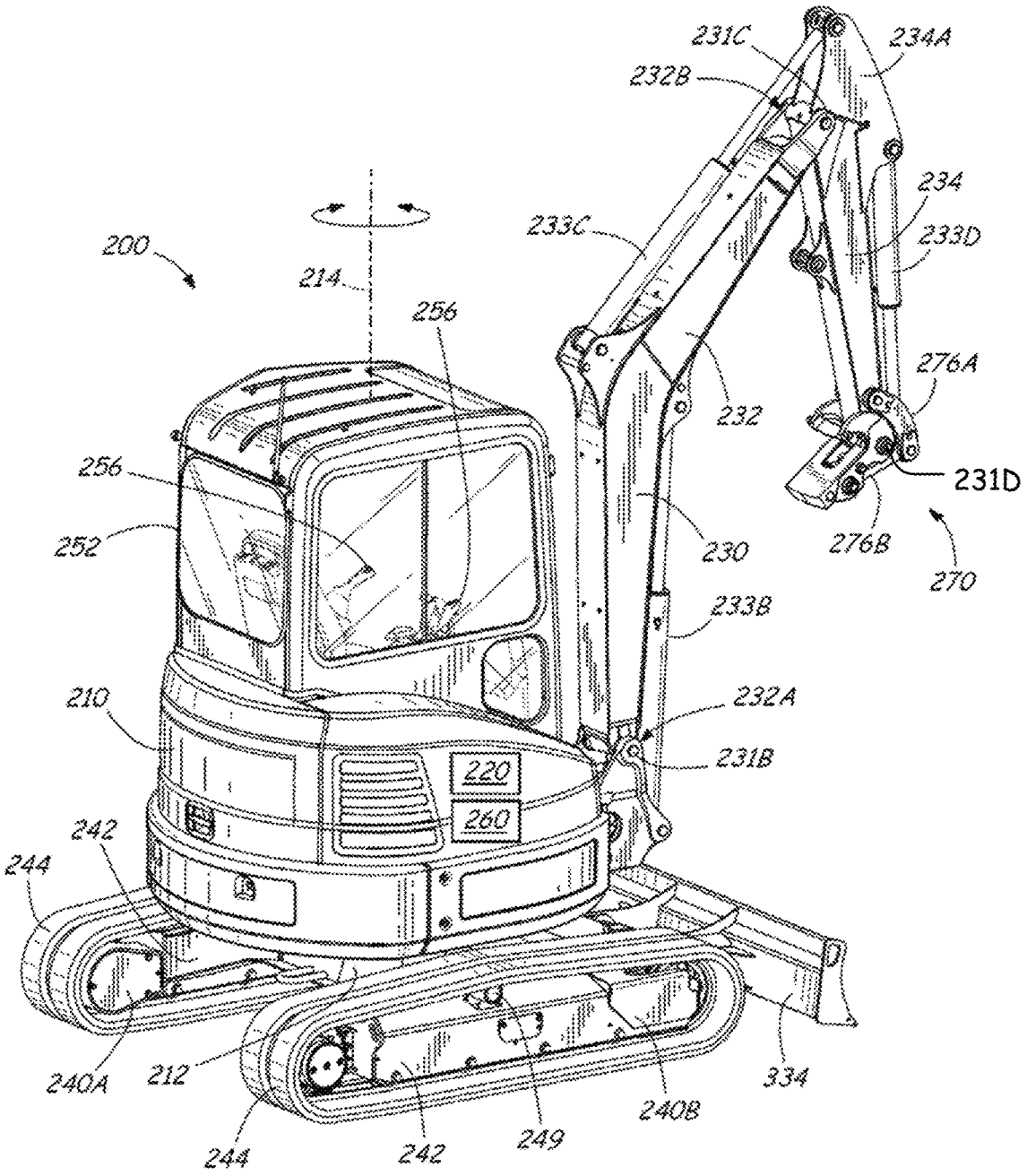
FIG. 3 is a rear right perspective view of the excavator of FIG. 2 in accordance with some configurations.

A representative power machine on which the embodiments can be practiced is illustrated in diagram form in FIG. 1 and one example of such a power machine is illustrated in FIGS. 2-3 and described below before any embodiments are disclosed. For the sake of brevity, only one power machine is discussed. However, as mentioned above, the embodiments below can be practiced on any of a number of power machines, including power machines of different types from the representative power machine shown in FIGS. 2-3. Power machines, for the purposes of this discussion, include a frame, at least one work element, and a power source that can provide power to the work element to accomplish a work task. One type of power machine is a self-propelled work vehicle. Self-propelled work vehicles are a class of power machines that include a frame, work element, and a power source that can provide power to the work element. At least one of the work elements is a motive system for moving the power machine under power.

Referring now to FIG. 1, a block diagram illustrates the basic systems of a power machine 100 upon which the embodiments discussed below can be advantageously incorporated and can be any of several distinct types of power machines. The block diagram of FIG. 1 identifies various systems on power machine 100 and the relationship between various components and systems. As mentioned above, at the most basic level, power machines for the purposes of this discussion include a frame, a power source, and a work element. The power machine 100 has a frame 110, a power source 120, and a work element 130. Because power machine 100 shown in FIG. 1 is a self-propelled work vehicle, it also has tractive elements 140, which are themselves work elements provided to move the power machine over a support surface and an operator station 150 that provides an operating position for controlling the work elements of the power machine. A control system 160 is provided to interact with the other systems to perform various work tasks at least in part in response to control signals provided by an operator.

Certain work vehicles have work elements that can perform a dedicated task. For example, some work vehicles have a lift arm to which an implement such as a bucket is attached such as by a pinning arrangement. The work element, e.g., the lift arm, can be manipulated to position the implement for performing the task. The implement, in some instances can be positioned relative to the work element, such as by rotating a bucket relative to a lift arm, to further position the implement. Under normal operation of such a work vehicle, the bucket is intended to be attached and under use. Such work vehicles may be able to accept other implements by disassembling the implement/work element combination and reassembling another implement in place of the original bucket. Other work vehicles, however, are intended to be used with a wide variety of implements and have an implement interface such as implement interface 170 shown in FIG. 1. At its most basic, implement interface 170 is a connection mechanism between the frame 110 or a work element 130 and an implement, which can be as simple as a connection point for attaching an implement directly to the frame 110 or a work element 130 or more complex, as discussed below.

On some power machines, implement interface 170 can include an implement carrier, which is a physical structure movably attached to a work element. The implement carrier has engagement features and locking features to accept and secure any of several implements to the work element. One characteristic of such an implement carrier is that once an implement is attached to it, it is fixed to the implement (i.e. not movable with respect to the implement) and when the implement carrier is moved with respect to the work element, the implement moves with the implement carrier. The term implement carrier is not merely a pivotal connection point, but rather a dedicated device specifically intended to accept and be secured to various different implements. The implement carrier itself is mountable to a work element 130 such as a lift arm or the frame 110. Implement interface 170 can also include one or more power sources for providing power to one or more work elements on an implement. Some power machines can have a plurality of work elements with implement interfaces, each of which may, but need not, have an implement carrier for receiving implements. Some other power machines can have a work element with a plurality of implement interfaces so that a single work element can accept a plurality of implements simultaneously. Each of these implement interfaces can, but need not, have an implement carrier.

Frame 110 includes a physical structure that can support various other components that are attached thereto or positioned thereon. The frame 110 can include any number of individual components. Some power machines have frames that are rigid. That is, no part of the frame is movable with respect to another part of the frame. Other power machines have at least one portion that can move with respect to another portion of the frame. For example, excavators can have an upper frame portion that rotates about a swivel with respect to a lower frame portion. Other work vehicles have articulated frames such that one portion of the frame pivots with respect to another portion for accomplishing steering functions. In exemplary embodiments, at least a portion of the power source is located in the upper frame or machine portion that rotates relative to the lower frame portion or undercarriage. The power source provides power to components of the undercarriage portion through the swivel.

Frame 110 supports the power source 120, which can provide power to one or more work elements 130 including the one or more tractive elements 140, as well as, in some instances, providing power for use by an attached implement via implement interface 170. Power from the power source 120 can be provided directly to any of the work elements 130, tractive elements 140, and implement interfaces 170. Alternatively, power from the power source 120 can be provided to a control system 160, which in turn selectively provides power to the elements that are capable of using it to perform a work function. Power sources for power machines typically include an engine such as an internal combustion engine and a power conversion system such as a mechanical transmission or a hydraulic system that can convert the output from an engine into a form of power that is usable by a work element. Other types of power sources can be incorporated into power machines, including electrical sources or a combination of power sources, known generally as hybrid power sources.

FIG. 1 shows a single work element designated as work element 130, but various power machines can have any number of work elements. Work elements are typically attached to the frame of the power machine and movable with respect to the frame when performing a work task. In addition, tractive elements 140 are a special case of work element in that their work function is generally to move the power machine 100 over a support surface. Tractive elements 140 are shown separate from the work element 130 because many power machines have additional work elements besides tractive elements, although that is not always the case. Power machines can have any number of tractive elements, some or all of which can receive power from the power source 120 to propel the power machine 100. Tractive elements can be, for example, wheels attached to an axle, track assemblies, and the like. Tractive elements can be rigidly mounted to the frame such that movement of the tractive element is limited to rotation about an axle or steerably mounted to the frame to accomplish steering by pivoting the tractive element with respect to the frame. In contrast to tractive elements and actuators, workgroup actuators and elements are configured to provide powered movement of one or more components of a power machine for work operations (i.e., other than for travel of the power machine over terrain). Correspondingly, "workgroup function" refers to one or more functions that relate to movement of one or more components of a power machine other than for travel of the power machine over terrain.

Power machine 100 includes an operator station 150, which provides a position from which an operator can control operation of the power machine. In some power machines, the operator station 150 is defined by an enclosed or partially enclosed cab. Some power machines on which the disclosed embodiments may be practiced may not have a cab or an operator compartment of the type described above. For example, a walk behind loader may not have a cab or an operator compartment, but rather an operating position that serves as an operator station from which the power machine is properly operated. More broadly, power machines other than work vehicles may have operator stations that are not necessarily similar to the operating positions and operator compartments referenced above. Further, some power machines such as power machine 100 and others, whether they have operator compartments or operator positions, may be capable of being operated remotely (i.e. from a remotely located operator station) instead of or in addition to an operator station adjacent or on the power machine. This can include applications where at least some of the operator-controlled functions of the power machine can be operated from an operating position associated with an implement that is coupled to the power machine. Alternatively, with some power machines, a remote-control device can be provided (i.e. remote from both of the power machine and any implement to which is it coupled) that can control at least some of the operator-controlled functions on the power machine.

FIGS. 2-3 illustrate an excavator 200, which is one particular example of a power machine of the type illustrated in FIG. 1, on which the disclosed embodiments can be employed. Unless specifically noted otherwise, embodiments disclosed below can be practiced on a variety of power machines, with the excavator 200 being only one of those power machines. Excavator 200 is described below for illustrative purposes. Not every excavator or power machine on which the illustrative embodiments can be practiced need have all the features or be limited to the features that excavator 200 has. Excavator 200 has a frame 210 that supports and encloses a power system 220 (represented in FIGS. 2-3 as a block, as the actual power system is enclosed within the frame 210). The power system 220 includes an engine that provides a power output to a hydraulic system. The hydraulic system acts as a power conversion system that includes one or more hydraulic pumps for selectively providing pressurized hydraulic fluid to actuators that are operably coupled to work elements in response to signals provided by operator input devices. The hydraulic system also includes a control valve system that selectively provides pressurized hydraulic fluid to actuators in response to signals provided by operator input devices. The excavator 200 includes a plurality of work elements in the form of a first lift arm structure 230 and a second lift arm structure 330 (not all excavators have a second lift arm structure). In addition, excavator 200, being a work vehicle, includes a pair of tractive elements in the form of left and right track assemblies 240A and 240B, which are disposed on opposing sides of the frame 210.

An operator compartment 250 is defined in part by a cab 252, which is mounted on the frame 210. The cab 252 shown on excavator 200 is an enclosed structure, but other operator compartments need not be enclosed. For example, some excavators have a canopy that provides a roof but is not enclosed A control system, shown as block 260 is provided for controlling the various work elements. Control system 260 includes operator input devices, which interact with the power system 220 to selectively provide power signals to actuators to control work functions on the excavator 200. In some embodiments, the operator input devices include at least two two-axis operator input devices to which operator functions can be mapped.

Frame 210 includes an upper frame portion or house 211 that is pivotally mounted on a lower frame portion or undercarriage 212 via a swivel joint. The swivel joint includes a bearing, a ring gear, and a slew motor with a pinion gear (not pictured) that engages the ring gear to swivel the machine. The slew motor receives a power signal from the control system 260 to rotate the house 211 with respect to the undercarriage 212. House 211 is capable of unlimited rotation about a swivel axis 214 under power with respect to the undercarriage 212 in response to manipulation of an input device by an operator. Hydraulic conduits are fed through the swivel joint via a hydraulic swivel to provide pressurized hydraulic fluid to the tractive elements and one or more work elements such as lift arm 330 that are operably coupled to the undercarriage 212.

The first lift arm structure 230 is mounted to the house 211 via a swing mount 215. (Some excavators do not have a swing mount of the type described here.) The first lift arm structure 230 is a boom-arm lift arm of the type that is generally employed on excavators although certain features of this lift arm structure may be unique to the lift arm illustrated in FIGS. 2-3. The swing mount 215 includes a frame portion 215A and a lift arm portion 215B that is rotationally mounted to the frame portion 215A at a mounting frame pivot 231A. A swing actuator 233A is coupled to the house 211 and the lift arm portion 215B of the mount. Actuation of the swing actuator 233A causes the lift arm structure 230 to pivot or swing about an axis that extends longitudinally through the mounting frame pivot 231A.

The first lift arm structure 230 includes a first portion 232, known generally as a boom 232, and a second portion 234, known as an arm, a dipper, or a stick. The boom 232 is pivotally attached on a first end 232A to mount 215 at boom pivot mount 231B. A boom actuator 233B is attached to the mount 215 and the boom 232. Actuation of the boom actuator 233B causes the boom 232 to pivot about the boom pivot mount 231B, which effectively causes a second end 232B of the boom to be raised and lowered with respect to the house 211. A first end 234A of the arm 234 is pivotally attached to the second end 232B of the boom 232 at an arm mount pivot 231C. An arm actuator 233C is attached to the boom 232 and the arm 234. Actuation of the arm actuator 233C causes the arm to pivot about the arm mount pivot 231C. Each of the swing actuator 233A, the boom actuator 233B, and the arm actuator 233C can be independently controlled in response to control signals from operator input devices.

An exemplary implement interface 270 is provided at a second end 234B of the arm 234. The implement interface 270 includes an implement carrier 272 that can accept and securing a variety of different implements to the lift arm structure 230. Such implements have a machine interface that is configured to be engaged with the implement carrier 272. The implement carrier 272 is pivotally mounted to the second end 234B of the arm 234 (e.g., via an implement interface pivot mount 231D). An implement carrier actuator 233D is operably coupled to the arm 234 and a linkage assembly 276. The linkage assembly includes a first link 276A and a second link 276B. The first link 276A is pivotally mounted to the arm 234 and the implement carrier actuator 233D. The second link 276B is pivotally mounted to the implement carrier 272 and the first link 276A. The linkage assembly 276 is provided to allow the implement carrier 272 to pivot about the arm 234 when the implement carrier actuator 233D is actuated.

The implement interface 270 also includes an implement power source (not shown in FIGS. 2-3) available for connection to an implement on the lift arm structure 230. The implement power source includes pressurized hydraulic fluid port to which an implement can be coupled. The pressurized hydraulic fluid port selectively provides pressurized hydraulic fluid for powering one or more functions or actuators on an implement. The implement power source can also include an electrical power source for powering electric actuators and/or an electronic controller on an implement. The electrical power source can also include electrical conduits that are in communication with a data bus on the excavator 200 to allow communication between a controller on an implement and electronic devices on the excavator 200. It should be noted that the specific implement power source on excavator 200 does not include an electrical power source. However, in some configurations, the specific implement power source or other power sources of an excavator or other power machine can include an electrically powered actuator, for example, when the excavator is an electrically powered work vehicle that includes an electrical power storage device (e.g., a battery). Correspondingly, control of actuators in some cases may not necessarily require control of hydraulic flow (e.g., may be accomplished via electronic control of an electric actuator by a control device).

The lower frame 212 supports and has attached to it a pair of tractive elements 240, identified in FIGS. 2-3 as left track drive assembly 240A and right track drive assembly 240B. Each of the tractive elements 240 has a track frame 242 that is coupled to the lower frame 212. The track frame 242 supports and is surrounded by an endless track 244, which rotates under power to propel the excavator 200 over a support surface. Various elements are coupled to or otherwise supported by the track 242 for engaging and supporting the track 244 and cause it to rotate about the track frame. For example, a sprocket 246 is supported by the track frame 242 and engages the endless track 244 to cause the endless track to rotate about the track frame. An idler 245 is held against the track 244 by a tensioner (not shown) to maintain proper tension on the track. The track frame 242 also supports a plurality of rollers 248, which engage the track and, through the track, the support surface to support and distribute the weight of the excavator 200. An upper track guide 249 is provided for providing tension on track 244 and preventing the track from rubbing on track frame 242.

A second, or lower, lift arm 330 is pivotally attached to the lower frame 212. A lower lift arm actuator 332 is pivotally coupled to the lower frame 212 at a first end 332A and to the lower lift arm 330 at a second end 332B. The lower lift arm 330 is configured to carry a lower implement 334, which in one embodiment is a blade as is shown in FIGS. 2-3. The lower implement 334 can be rigidly fixed to the lower lift arm 330 such that it is integral to the lift arm. Alternatively, the lower implement can be pivotally attached to the lower lift arm via an implement interface, which in some embodiments can include an implement carrier of the type described above. Lower lift arms with implement interfaces can accept and secure various different types of implements thereto. Actuation of the lower lift arm actuator 332, in response to operator input, causes the lower lift arm 330 to pivot with respect to the lower frame 212, thereby raising and lowering the lower implement 334.

Upper frame portion 211 supports cab 252, which defines, at least in part, operator compartment or station 250. A seat 254 is provided within cab 252 in which an operator can be seated while operating the excavator. While sitting in the seat 254, an operator will have access to a plurality of operator input devices 256 that the operator can manipulate to control various work functions, such as manipulating the lift arm structure 230 (e.g., the lower lift arm 330), operating the tractive elements 240, pivoting the house 211, and so forth.

Excavator 200 provides a variety of different operator input devices 256 to control various functions. For example, hydraulic joysticks are provided to control the lift arm structure 230 and swiveling of the house 211 of the excavator. Foot pedals with attached levers (e.g., as represented by box 213 in FIG. 2 are provided for controlling travel and lift arm swing. Electrical switches are located on the joysticks for controlling the providing of power to an implement attached to the implement carrier 272. Other types of operator inputs that can be used in excavator 200 and other excavators and power machines include, but are not limited to, switches, buttons, knobs, levers, variable sliders, and the like. The specific control examples provided above are exemplary in nature and not intended to describe the input devices for all excavators and what they control.

Display devices are provided in the cab to give indications of information relatable to the operation of the power machines in a form that can be sensed by an operator, such as, for example audible and/or visual indications. Audible indications can be made in the form of buzzers, bells, and the like or via verbal communication. Visual indications can be made in the form of graphs, lights, icons, gauges, alphanumeric characters, and the like. Displays can provide dedicated indications, such as warning lights or gauges, or dynamic to provide programmable information, including programmable display devices such as monitors of various sizes and capabilities. Display devices can provide diagnostic information, troubleshooting information, instructional information, and various other types of information that assists an operator with operation of the power machine or an implement coupled to the power machine. Other information that may be useful for an operator can also be provided.

Figure 4:
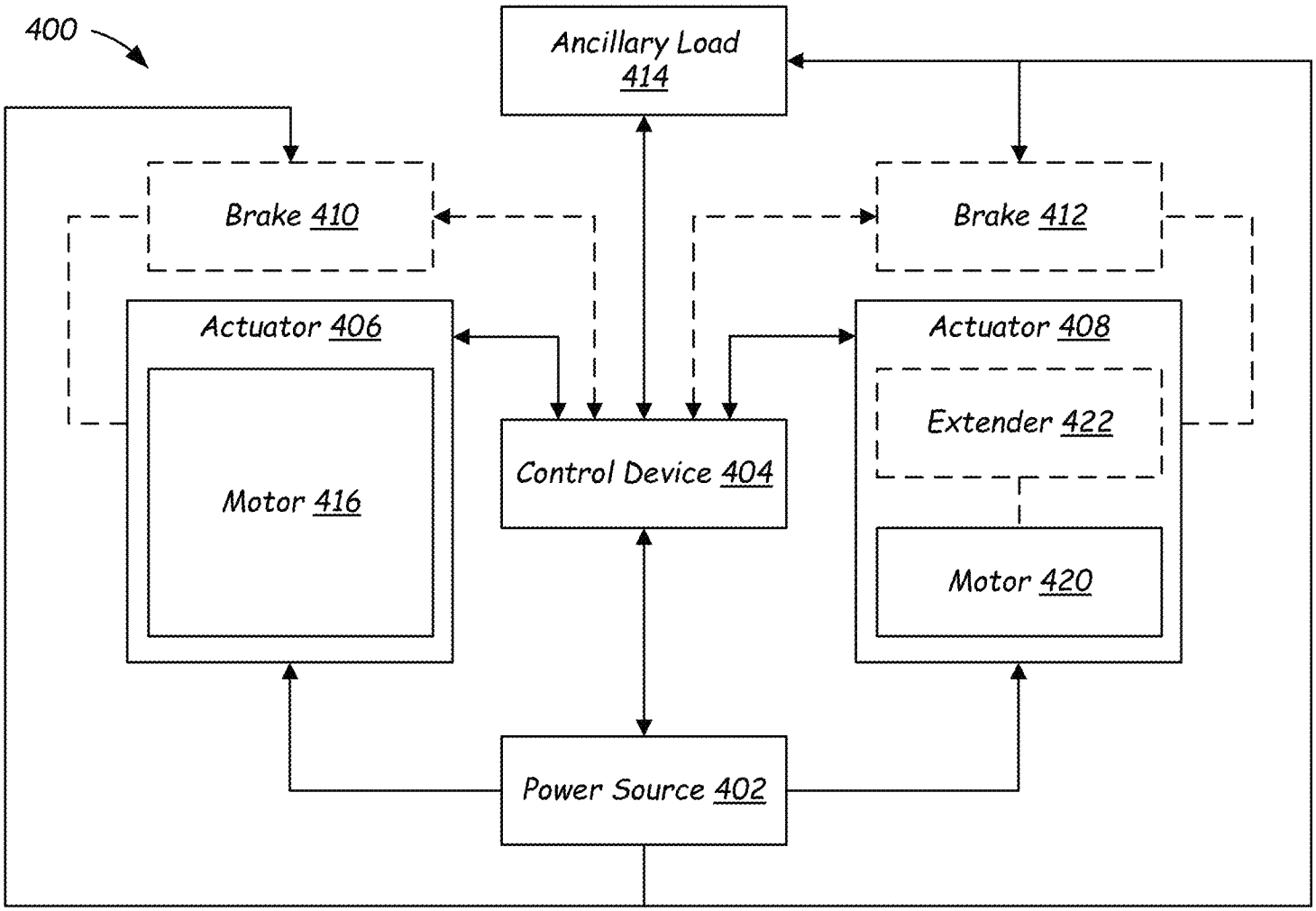
FIG. 4 schematically illustrates an example power machine in accordance with some configurations.

FIG. 4 shows a schematic illustration of a block diagram of a power machine 400, which can be any of a number of different types of power machines (e.g., wheeled or tracked skid-steer loaders, telescopic handlers (or telehandlers), articulated vehicles, etc.), including any of the types generally discussed above. To accomplish various work and drive operations, the power machine 400 can include a power source 402, a control device 404, and electric actuators 406, 408. Either or both of the electric actuators 406, 408 can be variously configured as one or more drive actuators, or one or more workgroup actuators, and a different number of individual actuators can be provided than is generally shown in FIG. 4. For example, as further discussed below, some power machines can include a left-side and right-side drive actuators, each including a respective electronic drive motor disposed to power an associate tractive element (e.g., an endless track assembly), as well as various extendable (or other) work actuators (e.g., one or more extendable lift arm actuators, one or more extendable tilt actuators, etc.). In some cases, as also shown in FIG. 4, one or more brakes 410, 412 can be configured to stop movement of an associated one or more of the actuators 406, 408, including based on control signals from the control device 404. While one or more brakes 410, 412 are shown in FIG. 4 as being distinct from the actuator 106, 408, respectively, the brakes in at least some embodiments consistent with the present disclosure may be integrated in the actuators themselves.

In the illustrated example, the power machine 400 can be an electrically powered power machine and thus the power source 402 can include an electric power source such as, for example, a battery pack that includes one or more battery cells (e.g., lithium-ion batteries). In some embodiments, the power source 402 can include other electric storage devices (e.g., a capacitor), and other power sources. In addition, the power machine 400 can, but need not, include an internal combustion engine that provides, via a generator, electric power to the power source 402 (e.g., to charge one or more batteries of the electric power source).

Generally, the control device 404 can be implemented in a variety of different ways and can include one or more types or instances of known electronic controllers. For example, the control device 404 can be implemented as known types of processor devices, (e.g., microcontrollers, field-programmable gate arrays, programmable logic controllers, logic gates, etc.), including as part of one or more general or special purpose computers. In addition, the control device 404 can also include or be in operative communication with other computing components, including memory, inputs, output devices, etc. (not shown). In this regard, the control device 404 can be configured to implement some or all of the operations of the processes described herein, which can, as appropriate, be retrieved from or otherwise interact with memory. In some embodiments, the control device 404 can include multiple control devices (or modules) that can be integrated into a single component or arranged as multiple separate components. In some embodiments, the control device 404 can be part of a larger control system (e.g., the control system 160 of FIG. 1) and can accordingly include or be in electronic communication with a variety of control modules, including hub controllers, engine controllers, drive controllers, and so on.

In different embodiments, different types of actuators can be configured to operate under power from the power source 402, including electric actuators configured as rotary actuators, linear actuators, and combinations thereof. In the example shown in FIG. 4, the actuator 406 is a drive actuator and includes an electric motor 416 that is configured to provide rotational power to one or more tractive elements (not shown in FIG. 4). As noted above, some power machines can include multiple drive actuators, including as can be arranged for skid-steer operation.

Also as shown in the example of FIG. 4, the actuator 408 is a workgroup actuator and thus includes an electric motor 420 that is configured to provide rotational power for operation of one or more non-drive work elements (e.g., a lift arm, an implement or implement carrier, boom, etc.). In some cases, the motor 420 can be configured to power movement of an extender 422 (e.g., a lead screw, a ball screw, another similar threaded assembly, or other known components for rotationally powered non-rotational movement), which can convert rotational power of the motor 420 into translational movement of the extender 422 so as to provide translational power to a work element of the power machine 400. For example, the motor 420 can rotate in a first direction to drive extension of the extender 422 and can rotate in a second direction, opposite the first direction, to drive retraction of the extender 422. In this way, and depending on how the electric actuator 406 is coupled to the components of the power machine 400, extension (and retraction) of the electric actuator 406 can, for example, raise (or lower) a lift arm or a boom of the power machine 400, change an attitude an implement of the power machine 400 (e.g., a bucket), etc.

Thus, generally, each motor 416, 420 can be controlled to implement particular functionality for the power machine 400. As generally noted above, different configurations of multiple drive or workgroup actuators can be included in some cases (e.g., multiple instances of the actuators 406, 408 as shown), to provide different functionality for a particular power machine. Although excavators are primarily discussed above and below, and the power machine 400 can represent the excavator 200 in some examples, other configurations are possible. Generally, the power machine 400 can include an electric actuator that is a first lift actuator, an electric actuator that is a first tilt actuator, an electric actuator that is a first drive actuator for a first drive system that is on (or otherwise powers one or more tractive elements for) the first lateral side of the power machine 400, and an electric actuator that is a second drive actuator for a second drive system that is on (or otherwise powers one or more tractive elements for) the second lateral side of the power machine 400.

As also noted above, the brakes 410, 412 can be coupled to (e.g., included in) the respective electric actuators 406, 408 in some embodiments. In this regard, a wide variety of known brake systems can be used. For example, one or more brakes can be a mechanical brake that includes a mechanical stop that can be moved into engagement to block movement of a relevant extender or relevant motor, in one or more directions, and can be moved out of engagement to allow movement of the relevant extender or motor. In some cases, a mechanical brake can include an arm that contacts a lead screw of an extender to block further movement of the lead screw. In some embodiments, one or more electrically powered brakes can be provided (i.e., brake assemblies that include one or more electric actuators for application or release of braking force).

As shown in FIG. 4, the power source 402 can be electrically connected to the control device 404, the electric actuators 406, 408, and the brakes 410, 412 (as appropriate), as well as one or more ancillary loads 414. Thus, the power source 402 can provide power to each motor 416, 420 to drive movement (e.g., extension and retraction) of the respective extenders 422, to the control device 404, to each brake 410, 412 (as appropriate), to each of the ancillary load(s) 414, etc. Further, the power source 402 can provide power to the ancillary loads 414 (i.e., loads not associated with providing tractive or workgroup power) for various ancillary functionality. For example, ancillary loads 414 can include a climate control system (e.g., including a heater, an air-conditioning system, a fan, etc.), a sound system (e.g., a speaker, a radio, etc.), etc. In some cases, ancillary loads 414 may be treated with lower priority according to certain power management modes.

As shown in FIG. 4, the control device 404 can be in electrical communication with the power source 402, the actuators 406, 408, the brakes 410, 412 (as appropriate), and the ancillary load(s) 414, and can adjust (e.g., limit) the power delivered from the power source 402 to, or the power consumed by, each of these electric loads (or others). For example, as appropriate, the control device 404 can adjust (e.g., decrease) the power delivered to each of these electric loads by adjusting (e.g., decreasing) the electric current that can be consumed by at least some of these electric loads. In some cases, the control device 404 can include or be in communication with an inverter or other motor drive/controller and can accordingly signal the inverter or other drive/controller to selectively adjust electric current delivered to either of the motors 416, 420.

In some embodiments, similarly to each of the electric loads of the power machine 400, the electric power source of the power source 402 can include (or can be otherwise electrically connected to) an electric current source (e.g., a power electronics board) that adjusts (e.g., and can restrict) the amount of power to be delivered to the electric loads of the power machine 400. In this case, the control device 404 can adjust the driving signal to the electric power source to adjust the total amount of electric current and thus the amount of power delivered to the electric loads of the power machine 400. For example, the control device 404 can adjust the output from the electric power source 402 to regulate the torque, position, direction, and speed of one or more motors powered by the power source 402.

In some embodiments, the control device 404 can be configured to determine a present (i.e., temporally current) power usage of one or more actuators or other electric loads, or a present power delivery from a power source. In some cases, a present power usage or delivery can be measured instantaneously. In some cases, a present power usage or delivery can be measured as an average power delivery over a recent time interval (e.g., a preceding 2 seconds). Thus, for example, the control device 404 can determine a present power usage for each electric load of the power machine 400, or can determine a present power delivery from the electric power source of the power source 402.

In some cases, each electric load of the power machine 400, and the power source 402 can include or can otherwise be electrically connected to an electric current sensor to determine the electric current being provided to (or by) the particular electric component, and a voltage being provided to (or by) the particular electric component can also be determined (e.g., based on voltage sensor or a fixed voltage provided by the power source 402). In this way, for example, the control device 404 can receive information about a present voltage and a present electric current that is delivered to each individual electric load, or about the present voltage and electric current that is supplied by the electric power source of the power machine 400 in total and can thereby determine a present power usage for relevant (e.g., all) electric loads and for the electric power source of the power machine 400.

In some embodiments, the control device 404 can determine a present power usage for the electric power source of the power machine 400 by adding the present power usage for each relevant electric load of the power machine 400 (e.g., as determined by multiplying electric current and voltage for the loads). Alternatively, for example, power can be determined by multiplying the torque and speed of one or more relevant motors. In certain circumstances, it may be advantageous to use either of these known methods. In other cases, the control device 404 can determine a present power usage of the electric power source of the power machine 400 only by determining the power delivered by the electric power source. For example, the control device 404 can receive a present value for electric current delivered by the electric power source 402 and, based on the voltage of the electric power source 402, can then determine a total present power usage for the electric power source. In some cases, the control device 404 can assume a substantially constant voltage for the electric power source and can then determine the present power usage of the electric power source by using the constant voltage and the present electric current value.

In some embodiments, the electric power source 402 can include or can be electrically connected to a sensor to sense a present remaining energy of the electric power source. In some cases, for example, a voltage sensor can sense the voltage of the electric power source, which can be indicative of the present remaining energy left within the electric power source (e.g., because the voltage of the electric power source can be related to the present remaining energy within the electric power source). Any suitable means for sensing the remaining energy of the electric power source can be used, including an accounting of how much electric current is supplied by the energy storage device over time.

In some embodiments, the power machine 400 can include one or more sensors that can sense various aspects of the power machine 400. For example, the power machine 400 can include a torque sensor for one or more electric actuators, to sense a present torque of the one or more electric actuator. In some cases, the torque sensor can be the same as the electric current sensor electrically connected to the electric actuator (e.g., because electric current is related to the torque). As another example, the power machine 400 can include a position sensor for one or more extenders or other components of one or more electric actuators (as appropriate), including as may sense a present extension amount for an extender of an electric actuator (e.g., relative to the housing of the electric actuator). In some cases, this can be a hall-effect sensor, a rotary encoder for the motor (e.g., which can be used to determine the extension amount of actuators with extenders), an optical sensor, etc. In some cases, the power machine 400 can include a resolver configured to track relative movement of an actuator. As yet another example, the power machine 400 can include an angle sensor for one or more pivotable joints (e.g., of the lift arm, the boom, the implement carrier, etc.) to determine a present orientation of the lift arm, the boom, the implement carrier, etc. (and any implement coupled thereto). As yet another example, the power machine 400 can include a speed sensor or an acceleration sensor (e.g., an accelerometer) to respectively determine a present speed or a present acceleration of the entire power machine 400 or of a component thereof. As still yet another example, the power machine 400 can include an inclinometer (e.g., an accelerometer) that can sense the present attitude of a mainframe of the power machine 400 with respect to gravity. Is another example, the power machine 400 can include a force sensor, such as, e.g., a strain gauge, that can sense the present external force on a component of the power machine 400 (e.g., a force on an electric actuator).

Figure 5:
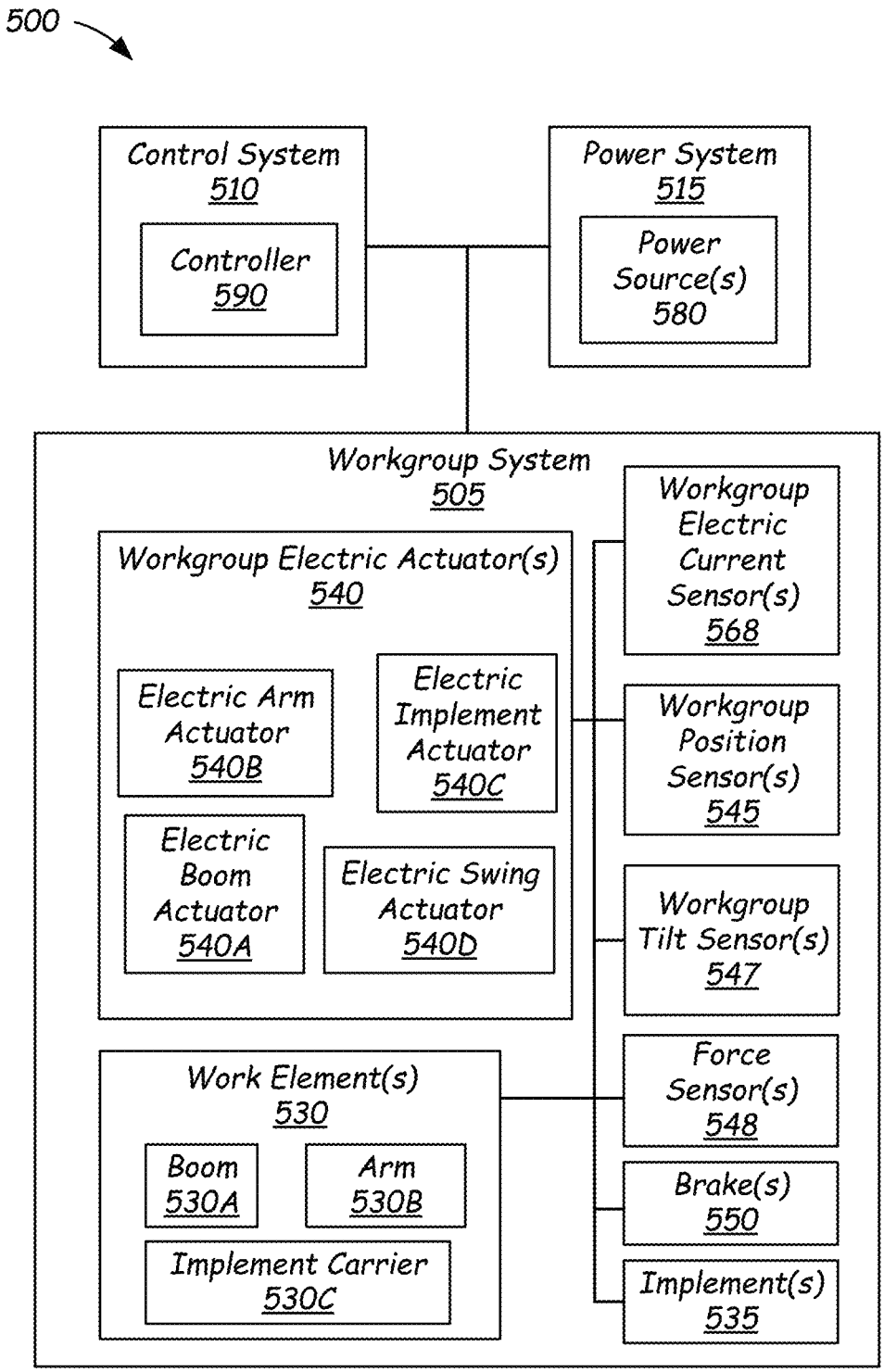
FIG. 5 schematically illustrates another example power machine in accordance with some configurations.

FIG. 5 is a schematic block diagram of a power machine 500, which can be an excavator or any of a number of different types of power machines, including any of the types generally discussed above (e.g., a wheeled or tracked skid-steer loader, a telescopic handler, an excavator, etc.). The power machine 500 may include a workgroup system 505, a control system 510, and a power system 515. The workgroup system 505, the control system 510, and the power system 515 communicate over one or more communication lines (e.g., buses). Generally, the power machine 500 may include additional, fewer, or different components than those illustrated in FIG. 5 in various configurations and may perform additional functionality than the functionality described herein. For example, the power machine 500 may include additional, similar, or different components, systems, and functionality as described above with respect to the power machine 100 of FIG. 1, the excavator 200 of FIGS. 2-3, the power machine 400 of FIG. 4, or another power machine described herein.

As illustrated in FIG. 5, the workgroup system 505 may include one or more work elements 530, which may be for example the work element 130 of FIG. 1, and are generally discussed below as work elements of a lift arm structure for an excavator (although other configurations are possible). The workgroup system 505 includes one or more implements 535, one or more workgroup electric actuators 540, one or more workgroup position sensors 545 (e.g., including one or more workgroup tilt sensors 547), one or more workgroup force sensors 548, one or more brakes 550, and one or more workgroup electric current sensors 555. Generally these noted elements can be included individually or in pluralities, and discussion herein accordingly may refer to these elements in the singular or plural for convenience (e.g., collectively, the work elements 530, or individually, the work element 530).

Generally, the workgroup system 505 may include additional, fewer, or different components than those illustrated in FIG. 5 in various configurations and may perform additional functionality than the functionality described herein. As one example, the workgroup system 505 or component(s) thereof may include additional components or sub-components. As another example, one or more current sensors 568 may be included in some configurations that do not include separate corresponding force sensors 548 (or vice versa). Similarly, although the workgroup position sensor(s) 545 can include the tilt sensor(s) 547 as noted above, the position sensor(s) 545 may not include the tilt sensor(s) 547 in some arrangements.

In this regard, for some implementations of the technology disclosed herein, inclusion of the workgroup electric current sensor(s) 555 and, distinctly, the workgroup force sensor(s) 548 may provide beneficial redundancy, including for improved data integrity and accuracy. Similarly, in some implementations of the technology disclosed herein, the workgroup tilt sensor(s) 547 may provide beneficial redundancy for other included workgroup position sensor(s) 545, e.g., also for improved data integrity and accuracy.

In the illustrated example, the workgroup electric actuators 540 may include an electric boom (e.g., lift) actuator 540A, an electric arm actuator 540B, an electric implement (e.g., tilt) actuator 540C, and an electric swing actuator 540D. In some cases, an electric slew actuator may also be included (not shown). The workgroup electric actuators 540 may include additional, fewer, or different components than those illustrated in FIG. 5 in various configurations and may perform additional functionality than the functionality described herein. Generally, electric workgroup actuators corresponding to the electric boom actuator 540A, the electric arm actuator 540B, the electric implement actuator 540C, and the electric swing actuator 540D are described in greater detail herein with respect to FIGS. 1-4 (e.g., relative to the boom actuator 233B, the swing actuator 233A, the arm actuator 233C, and the implement carrier actuator 233D of FIGS. 2-3 or the electric actuators 406, 408 of FIG. 4).

As illustrated in the example of FIG. 5, the work elements 530 may include a boom 530A (e.g., the boom 232 of FIGS. 2-3), an arm 530B (e.g., the lift arm 234 of FIGS. 2-3), and an implement carrier 530C (e.g., the implement carrier 272 of FIGS. 2-3) or other interface for an implement for work operations. The work element(s) 530 can be manipulated via operation of the workgroup electric actuator(s) 540 to position the implement 535 for performing a task. As described in greater detail herein with respect to FIGS. 1-4, the work element(s) 530 may generally be manipulated to pivot about an axis due to extension or retraction of one or more corresponding actuators 540, although other configurations are possible.

Figure 6:
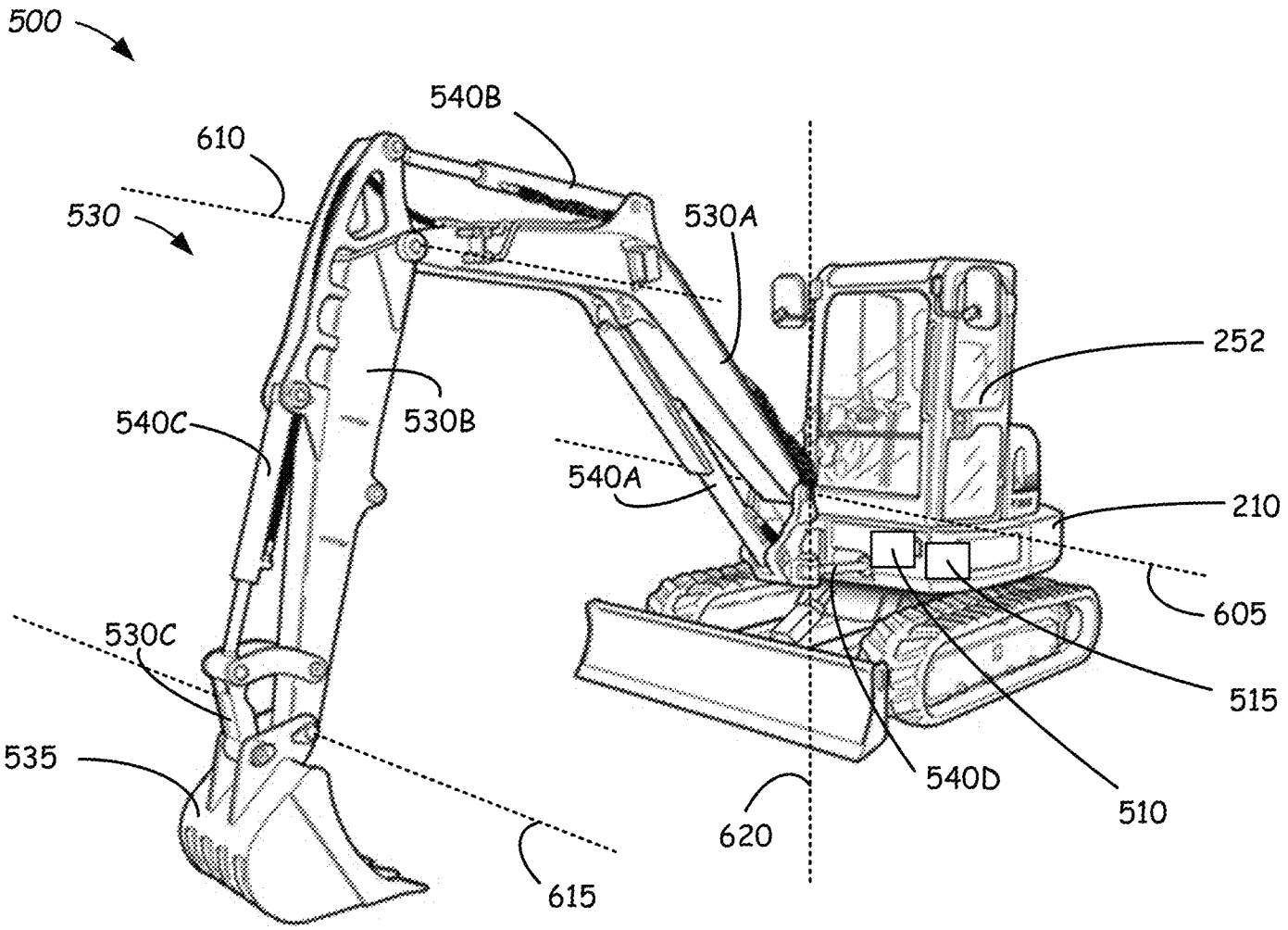
FIG. 6 is a side perspective view of a representative power machine in accordance with some configurations.

With reference to FIG. 6, in a particular example, actuation of the electric boom actuator 540A causes the boom 530A to pivot about an axis 605 that extends longitudinally through a boom pivot mount (e.g., the boom pivot mount 231B of FIGS. 2-3), which effectively causes a distal end (relative to the boom pivot mount) of the boom 530A to be raised and lowered. Actuation of the electric arm actuator 540B causes the lift arm 530B to pivot about an axis 610 that extends longitudinally through an arm mount pivot (e.g., the arm mount pivot 231C of FIGS. 2-3), which effectively causes the arm 530B to be raised and lowered. Actuation of the electric implement actuator 540C may cause the implement 535 to pivot about an axis 615 that extends longitudinally through an implement interface pivot mount (e.g., the implement interface pivot mount 231D of FIGS. 2-3), which effectively causes a tilt angle of the implement 535 to change. Actuation of the electric swing actuator 540C causes the work element 530 (e.g., the boom 530A) to pivot or swing about an axis 620 that extends longitudinally through a mounting frame pivot (e.g., the mounting frame pivot 231A of FIGS. 2-3).

Referring again to FIG. 5, the workgroup position sensors 545 can be configured to measure a linear extension or angular orientation of an actuator or other component of a workgroup. The workgroup tilt sensor(s) 547, in particular, can be arranged to measure a degree of tilt between the implement 535 and a supporting one of the work elements 530 (e.g., the arm 530B, although other tilt measurements are possible). The force sensor(s) 548 can be configured to measure a force on the workgroup electric actuator(s) 540 (e.g., an external force). In some cases, a strain gauge can be used as the force sensor 548 to measure force via detection of changes in structural shape. Relatedly, for example, the workgroup electric current sensors 568 can be configured to measure the electric current being provided to the workgroup electric actuator(s) 540 (e.g., as an alternative approach to identifying forces on particular actuators, without necessarily requiring separate force sensors). In some cases, the workgroup electric current sensor 568 can be used as a torque sensor can be used as (e.g., because electric current is related to motor torque) or otherwise as the force sensor 548. In some examples, one or more of the workgroup position sensors 545, the force sensors 548, or the workgroup electric current sensors 568 can be integrated into one or more of the workgroup electric actuators 540 or a control system thereof (e.g., can be included as part of the electric boom actuator 540A, the electric arm actuator 540B, the electric implement actuator 540C, or the electric swing actuator 540D). In some examples, a motor controller or a corresponding electric motor can itself be a current, force, or position sensor, in that these devices can be configured to provide signals to a separate control module that indicate current draw by the motor, with the signals thus correspondingly indicating forces and positions for the motor and associated components (e.g., ball screws or other extenders operated by the motor).

The workgroup electric current sensor(s) 568 may collect information about a present electric current that is delivered to or drawn by the workgroup electric actuator(s) 540 (e.g., as described herein with respect to FIG. 4). The workgroup position sensor(s) 545 may collect position data for the power machine 500 (or a component thereof). Generally, position data may include a lift height of the work element 530 (e.g., the boom 530A, the arm 530B, etc.), an extension amount of the electric boom actuator 540A, the electric arm actuator 540B, or other actuators, or the like.

As one example, the workgroup position sensor 545 may be associated with one of the workgroup electric actuators 540, and may detect position data for the associated workgroup electric actuator 540. For example, the workgroup position sensors 545 may measure or otherwise indicate rotational position data for an electric servo motor.

As another example, the workgroup position sensors 545 may be associated with extenders of the workgroup electric actuators 540 (e.g., ball screws or other motor-driven extenders). Accordingly, in some configurations, the workgroup position sensors 545 may sense a present extension amount (as position data) for the extender of each relevant workgroup electric actuator 540 (e.g., an extension distance relative to a housing of the workgroup electric actuator 540).

In some cases, the workgroup position sensor 545 may be a hall-effect sensor, a rotary encoder for the motor (e.g., which can be used to determine the extension amount of actuators with extenders), an optical sensor, etc.

As a specific implementation of a position sensor, the workgroup tilt sensor(s) 547 may collect tilt orientation data for the power machine 500 (or a component thereof). In some configurations, the workgroup tilt sensor 547 may be an angle sensor for each relevant pivotable joint of the work element 530 (or component(s) thereof), arranged to determine a present orientation of the work element 530 or a component thereof (or the implement(s) 535 coupled thereto). In some configurations, the workgroup tilt sensor 547 may determine a present (i.e., temporally current) attitude of the implement 535 relative to the arm 530B (e.g., a degree of tilt of an attached bucket or other implement) (as position data) or relative to gravity.

The power machine 500 may also include the power system 515 (e.g., the power system 220 of FIGS. 2-3). In the illustrated example of FIG. 5, the power system 515 may include one or more power sources 580 (e.g., the power source 402 of FIG. 4). As described herein, the power machine 500 can be an electrically powered power and thus the power system 515 (via one or more of the power sources 580) may generate or otherwise provide electric power for operating various functions on the power machine 500 (or components thereof). The power system 515 may correspondingly provide electric power to various components of the power machine 500, e.g., one or more components of the control system 510, the workgroup system 505 (including, e.g., the workgroup electric actuator(s) 540), or the like. Generally, the power source(s) 580 of the power system 515 can thus include electric power sources, e.g., a battery pack that includes one or more battery cells (e.g., lithium-ion batteries). In some configurations, the power system 515 can include other electric storage devices (e.g., a capacitor), and other power sources. Alternatively, or in addition, the power machine 500 may include an internal combustion engine that provides electrical power to the power sources 580 via a generator (e.g., to charge one or more batteries of the power system 515).

The power machine 500 may also include the control system 510. The control system 510 (e.g., the control system 160 of FIG. 1, the control system 260 of FIGS. 2-3, etc.) is configured to receive operator input or other input signals (e.g., sensor data, such as speed data, electric current data, position data, tilt or orientation data, or a combination thereof) and to output commands accordingly to control operation of the power machine 500. For example, the control system 510 can communicate with other systems of the power machine 500 to perform various work tasks, including to control the workgroup electric actuator(s) 540 for performing a work task operation (e.g., a digging operation, a roading operation, a trenching operation, etc.), or another operation of the power machine 500.

In some configurations, the control system 510 receives input from an operator input device, such as one of the operator input devices 256 of FIGS. 2-3, including input as command signals provided by an operator of the power machine 500 via the operator input device 256 (also referred to herein as "operator commands" or "commands"). As one example, an operator command may include a commanded lift for the workgroup system 505 of the power machine 500 (e.g., a change in lift of the work element 530 at which the operator of the power machine 500 requests or commands).

In response to receiving the input, the control system 510 may control the power machine 500 to perform the requested operation or otherwise maneuver based at least in part on the input received from the operator input device or the sensed operation data. Accordingly, in some configurations, the control system 510 may receive an input parameter corresponding to an operator command for operating the power machine 500 or sensed operation data of the power machine 500.

Figure 7:
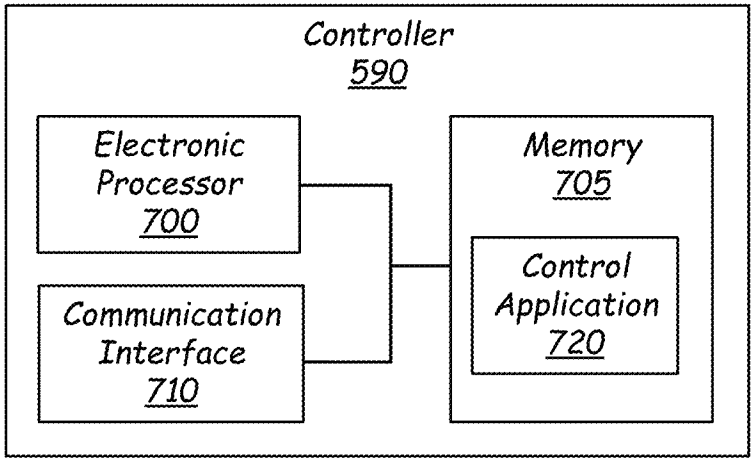
FIG. 7 schematically illustrates a controller of the power machine of FIG. 5 in accordance with some configurations.

As illustrated in FIG. 5, the control system 510 includes a controller 590 (e.g., the control device 404 of FIG. 4). FIG. 7 illustrates the controller 590 according to some configurations. In the illustrated example of FIG. 7, the controller 590 includes an electronic processor 700 (for example, a microprocessor, an application-specific integrated circuit ("ASIC"), or another suitable electronic device), a memory 705 (for example, a non-transitory, computer-readable medium), and a communication interface 710. The electronic processor 700, the memory 705, and the communication interface 710 communicate over one or more communication lines or buses. The controller 590 may include additional components than those illustrated in FIG. 7 in various configurations and may perform additional functionality than the functionality described herein. As one example, in some embodiments, the functionality described herein as being performed by the controller 590 may be distributed among other components or devices (e.g., one or more electronic processors).

The communication interface 710 may include a port for receiving a wired connection to an external device (for example, a universal serial bus ("USB") cable and the like), a transceiver for establishing a wireless connection to an external device (for example, over one or more communication networks, such as the Internet, local area network ("LAN"), a wide area network ("WAN"), and the like), or a combination thereof. In some configurations, the controller 590 can be a dedicated or stand-alone controller. In some configurations, the controller 590 can be part of a system of multiple distinct controllers (e.g., a hub controller, a drive controller, a workgroup controller, etc.) or can be formed by a system of multiple distinct controllers (e.g., also with hub, drive, and workgroup controllers, etc.).

The electronic processor 700 is configured to access and execute computer-readable instructions ("software") stored in the memory 705. The software may include firmware, one or more applications, program data, filters, rules, one or more program modules, and other executable instructions. For example, the software may include instructions and associated data for performing a set of functions, including the methods described herein.

For example, as illustrated in FIG. 7, the memory 705 may include a control application 720 (referred to herein as "the application 720"). The application 720 may be a software application executable by the electronic processor 700 in the example illustrated and as specifically discussed below, although a similarly purposed module may be implemented in other ways in other examples. The application 720 may implement a control loop for controlling one or more of the workgroup electric actuators 540 using a force control scheme, to facilitate force relief or mitigation for the workgroup electric actuator(s) 540 resulting from an external force applied to the workgroup electric actuator(s) 540, as described in greater detail herein.

Figure 8:
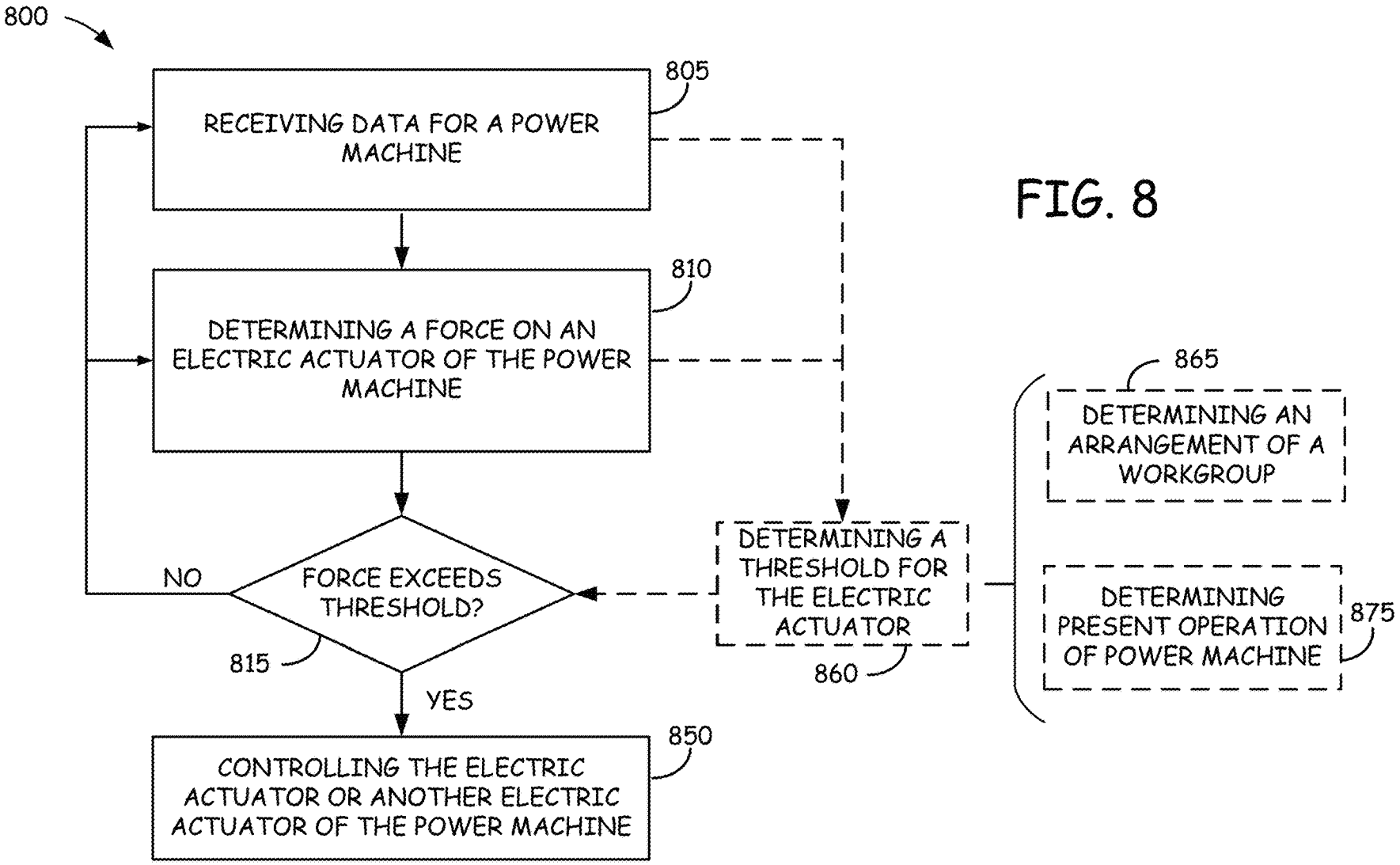
FIG. 8 is a flowchart illustrating a method of controlling a power machine in accordance with some configurations.

FIG. 8 is a flowchart illustrating a method 800 for controlling a power machine (e.g., the power machine 500) according to some configurations. In some configurations, the method 800 can be performed by the control system 510 (e.g., the controller 590) and, in particular, by the electronic processor 700 of the controller 590. However, as noted above, the functionality described with respect to the method 800 may be performed by other devices or can be distributed among a plurality of devices or components (e.g., one or more electronic processors).

As illustrated in FIG. 8, the method 800 may include receiving, with the electronic processor 700, data for the power machine 500 (at block 805). In some configurations, the electronic processor 700 may receive the data while the power machine 500 is performing an operation. In some configurations, the operation may be a digging operation, a trenching operation, a roading operation, etc.

The data may also be referred to herein as operational or operation data. The operational may include input data received from the operator input device (e.g., operator commands) or sensed operation data. An operator command may include input data received via the operator input device(s) from an operator of the power machine 500 (e.g., as operator control signals from a joystick of other electronic input device). Sensed operation data may include data collected by one or more sensors of the power machine 500, e.g., the workgroup electric current sensor(s) 568, the workgroup positions sensor(s) 545, the workgroup tilt sensor(s) 547, or the force sensor(s) 548.

In some configurations, the operational data may include position data collected by the workgroup position sensor(s) 545 or the workgroup tilt sensor(s) 547, including position data that specifies an extension amount or angular orientation of an actuator of a workgroup, a degree of tilt between the implement 535 and the work element(s) 530 (e.g., the arm 530B) or other workgroup components, a lift height of the implement 535 or other workgroup component, etc. In some cases, as further discussed below, position data can specify workgroup geometry information (i.e., geometric relationships between workgroup components in a present orientation or configuration).

Alternatively, or in addition, the operational data may include electric current related data collected by the workgroup electric current sensor(s) 568, such as, e.g., a present electric current draw of a corresponding workgroup electric actuator 540 (e.g., as electric current information). Alternatively, or in addition, the operational data may include force data collected by the force sensor(s) 548 or extrapolated from electric current draw. For example, operational data may include a present force of, or present force induced on, a corresponding workgroup electric actuator 540 (e.g., as induced force information).

Accordingly, in some configurations, the electronic processor 700 may receive the operational data for the power machine 500 from an operator input device, the workgroup position sensor(s) 545, the workgroup tilt sensor(s) 547, the force sensor(s) 548, the workgroup electric current sensor(s) 568, another component or device of the power machine 500, etc. Similarly, operational data may include, e.g., workgroup geometry information, operator control signals, induced force information, or electric current information.

The electronic processor 700 may determine, based on the data, a force on a workgroup electric actuator 540 of the power machine 500 (at block 810). In some instances, the force on a workgroup electric actuator 540 is a present (temporally) force experienced by or induced on the workgroup electric actuator 540. Accordingly, in some instances, force may refer to an external force.

In some configurations, the force may be induced on the workgroup electric actuator 540 as a result of movement of the workgroup electric actuator 540. As one example, the workgroup electric actuators 540 may include an electric tilt actuator associated with the implement carrier 530C (e.g., the electric implement actuator 540C). Following this example, the electric implement actuator 540C may be controlled to adjust a tilt angle of the implement 535 as part of performing a digging operation, so that the implement 535 contacts a ground surface. As a result of the implement 535 contacting the ground surface, a responsive force may be applied to the electric implement actuator 540C to maintain or adjust the tilt angle.

Alternatively, or in addition, in some configurations, the force may be induced on the workgroup electric actuator 540 as a result of movement of another workgroup electric actuator 540. As one example, an external force may be induced on the electric implement actuator 540C as a result of the electric arm actuator 540B performing a digging operation (e.g., movement of the electric arm actuator 540B). For instance, when the electric arm actuator 540B is extended, the arm 530B is moved downward (e.g., towards a cab or frame of the power machine 500), which may ultimately cause the implement 535 to contact the ground surface (or dig into the ground). This contact with the ground surface may induce an external force on the electric implement actuator 540C. Other forces can be similarly induced with other combinations of actuators, including induced forces on lift actuator 540A from operation of the tilt actuator 540C (and vice versa), etc.

In some configurations, the electronic processor 700 may determine the force on the workgroup electric actuator 540 based on force related data collected by the force sensor(s) 548 (e.g., induced force information). Alternatively, or in addition, the electronic processor 700 may determine the force on the workgroup electric actuator 540 based on a torque of the workgroup electric actuator 540 (e.g., a torque on a nut of a ball screw of the workgroup electric actuator 540). For example, in some instances, the electronic processor 700 may receive torque data for the workgroup electric actuator 540 (e.g., as part of or separate from the data received at block 805 of FIG. 8). The electronic processor 700 may convert a torque associated with the workgroup electric actuator 540 to a force of the workgroup electric actuator 540 (e.g., as torque is related to force).

Alternatively, or in addition, the electronic processor 700 may determine the force on the workgroup electric actuator 540 based on electric current data for the workgroup electric actuator 540, characteristics associated with the workgroup electric actuator 540 (e.g., a corresponding motor, brake, etc.), or a combination thereof. For instance, the electronic processor 700 may determine (e.g., estimate) a torque for the workgroup electric actuator 540 based on an electric current of the workgroup electric actuator 540 (e.g., as electric current is related to torque). The electronic processor 700 may then determine, for example, a linear or other force for the workgroup electric actuator 540 using the determined torque (e.g., using known characteristics of the actuator 540 to relate torque to the linear or other force).

The electronic processor 700 may detect (or otherwise determine) when the force exceeds a threshold (at block 815). For instance, the electronic processor 700 may compare the force (as determined at block 810) with a predetermined or calculated maximum force threshold. In some configurations, a threshold may be specific to a workgroup electric actuator 540. For example, a threshold may be specific to or based on a particular workgroup electric actuator 540, a corresponding work element controlled by the workgroup electric actuator 540, an actuator type or classification of the workgroup electric actuator 540, etc. In this regard, for example, the electric arm actuator 540B may have a first threshold and the electric boom actuator 540A may have a second threshold that is different from the first threshold. In such instances, the threshold for each workgroup electric actuator 540 may be based on specifications or characteristics of the workgroup electric actuator 540 (e.g., a manufacturer recommended maximum force limit), as appropriate.

In some configurations, the threshold may be a predetermined, static threshold. As described in greater detail herein, the threshold for each workgroup electric actuator 540 may also, or alternatively, be determined based on other considerations or factors. For example, force thresholds can be adaptively determined based on a present geometric arrangement of a workgroup (or components thereof) of the power machine 500, or based on a present work task, operation, or operational sequence being performed by or commanded for the power machine 500. In other words, as described in greater detail herein, a threshold may in some cases be a dynamic threshold based on, e.g., specifications of the workgroup electric actuator 540, a present geometric arrangement of a workgroup (or components thereof), a present work task, operation, or operational sequence, etc.

Alternatively, or in addition, in some configurations, the threshold may be substantially equal for each workgroup electric actuator 540. For example, the electric arm actuator 540B may have a first threshold and the electric boom actuator 540A may have a second threshold that is substantially equal to the first threshold.

When the electronic processor 700 determines that the (relevant) force does not exceed the threshold (e.g., "No" at block 815), the electronic process 700 may repeat one or more process steps of the method 800 (e.g., blocks 805, 810, 815). Accordingly, in some configurations, the electronic processor 700 may continuously monitor the workgroup electric actuator(s) 540 for forces that exceed the threshold. For example, the electronic processor 700 may continuously receive data for the electric power machine (e.g., as described herein with respect to block 805), determine a force exerted on the workgroup electric actuator(s) 540 based on the data (e.g., as described herein with respect to block 810), and detect when a force exceeds the threshold (e.g., as described herein with respect to block 815).

When the electronic processor 700 determines that the force exceeds the threshold (e.g., "Yes" at block 815), the method 800 may proceed to block 850. At block 850, the electronic processor 700 may control one or more of the workgroup electric actuators 540 such that a force limit (e.g., as represented by the threshold) is enforced. For example, the electronic processor 700 may control the workgroup electric actuator 540 or another workgroup electric actuator such that an updated force on the workgroup electric actuator 540 does not exceed a relevant force limit threshold, thereby effectively emulating the threshold-pressure relief provided in traditional port relief systems for hydraulic actuators.

In some configurations, the electronic processor 700 may control the workgroup electric actuator 540 responsive to the force exerted on the workgroup electric actuator 540 exceeding the threshold. Alternatively, or in addition, the electronic processor 700 may control another workgroup electric actuator responsive to the force exerted on the workgroup electric actuator 540 exceeding the threshold. For example, another actuator can be controlled to relieve excessive force on the actuator 540 by changing an overall orientation of a workgroup or by changing the application of force by a remotely located portion of the workgroup.

In some configurations, the electronic processor 700 may enforce a force limit induced on one or more of the workgroup electric actuators 540 by controlling the workgroup electric actuator(s) 540 that induce(s) the external force (e.g., as induced on the controlled actuator(s) 540, or on other actuator(s) 540 otherwise due to forces applied by the controlled actuator(s) 540). In this regard, in some examples, the workgroup electric actuator 540 may induce a force on itself. For example, when the electric implement actuator 540C adjusts a tilt position of the implement 535 (e.g., as part of performing a digging operation), the electric implement actuator 540C may experience a force that exceeds the threshold, with that force being the result of actuation of the electric implement actuator 540C for the tilt adjustment. Following this example, the electronic processor 700 may control the electric implement actuator 540C as part of enforcing a force limit for the electric implement actuator 540C. Accordingly, in some implementations, an operator control signal received by the electronic processor 700 may be modified, based upon the detected or anticipated over-force event, to decrease the requested movement, the acceleration of the movement, and/or force output of the electric implement actuator 540C.

Alternatively, or in addition, in some examples, the workgroup electric actuator 540 causing the external force may be different from the workgroup electric actuator 540 experiencing the external force. For instance, when the implement 535 is engaged with a load material and the electric boom actuator 540A changes a lift position to lift the implement 535, the electric implement actuator 540C may experience an external force exceeding the threshold due (at least in part) by the electric boom actuator 540A changing a lift position. Following this example, the electronic processor 700 may control the electric boom actuator 540A as part of enforcing a force limit for the electric implement actuator 540C. Similar other control can also sometimes be implemented in reverse (e.g., to enforce a load limit on the actuator 540A during movement of the actuator 540C) or with other combinations of actuators.

As also noted above, in some configurations, the electronic processor 700 may enforce a force limit for one or more of the workgroup electric actuators 540 by controlling the same or a different workgroup electric actuator 540. The electronic processor 700 may generally control the relevant workgroup electric actuator(s) 540 by adjusting an electric current provided to the workgroup electric actuator(s) 540. For example, the electronic processor 700 may increase (or decrease) an electric current of the workgroup electric actuator 540 experiencing the external force or causing the external force. In some configurations, the electronic processor 700 may adjust the electric current provided to the workgroup electric actuator(s) 540 until the electronic processor 700 determines that the external force no longer exceeds the threshold (e.g., is equal to or less than the threshold). Alternatively, or in addition, the electronic processor 700 may adjust the electric current provided to the relevant workgroup electric actuator(s) 540 to a predetermined electric current (e.g., with the predetermined electric current corresponding to the threshold force for the relevant actuator 540).

In some configurations, the electronic processor 700 may determine a present force on the workgroup electric actuator 540 based on a present electric current of the actuator 540. For example, the electronic processor 700 may monitor a present electric current draw of the electric actuator 540 while commanding movement of the actuator 540 (or another actuator) to detect a change in electric current that results in the electric current (and, correspondingly, motor force) exceeding a relevant threshold. As also generally discussed above and below, responsive to detecting the change, one or more of the electric actuators 540 (or other actuators) can then be controlled to reduce a force on a relevant one or more of the actuators 540.

In some configurations, the electronic processor 700 may enforce a force limit for the workgroup electric actuator 540 by controlling the workgroup electric actuator 540 to move in a direction of the external force (e.g., in the same direction as the external force). This can help to mitigate the external force, for example, by effectively causing the actuator 540 to at least partly yield to the external force. In some instances, the electronic processor 700 may actively control the workgroup electric actuator 540 to move in the direction of the external force. Alternatively, or in addition, the electronic processor 700 may control the workgroup electric actuator 540 to move in the direction of the external force by allowing the workgroup electric actuator 540 to move in that direction (e.g., by disengaging the brake 550 of the workgroup electric actuator 540, removing or reducing an electric current holding the workgroup electric actuator 540 at a substantially static position, etc.) thereby allowing the actuator to relieve some of the external force applied thereon.

In some configurations, the electronic processor 700 may determine the force on the workgroup electric actuator 540 while a brake 550 of the workgroup electric actuator 540 is engaged. In such configurations, the electronic processor 700 may control the workgroup electric actuator 540 by disengaging the brake 550 of the workgroup electric actuator 540. The electronic processor 700 may then control the workgroup electric actuator 540 by commanding an opposing force to the external force. In some examples, the opposing force may be substantially equal to the threshold. By commanding such an opposing force, for example, the electronic processor 700 can effectively replace the brake 550 with an active force command, while also allowing enforcement of the overall force limit on the actuator 540 (or related structures).

Accordingly, in some instances, the technology disclosed herein may implement force control, such as, force balancing, for actuators of a power machine as described by U.S. Provisional Application No. 63/580,063, filed Sep. 1, 2023, which is incorporated herein by reference in its entirety.

In some examples, a similar approach can also be used in the absence of a brake. For example, the electronic processor 700 may in some configurations maintain the electric actuator 540 in a stationary orientation, against a load, by actively commanding a force at the actuator 540. In such a case, a brake may not be engaged and need to be released as discussed above, but the electronic processor 700 may otherwise similarly command an opposing force to ensure compliance with a relevant force limit (e.g., may set a maximum holding force for the actuator 540 to allow movement in response to excessive loading).

As one operational example, as part of performing a digging operation with the implement 535, the electronic processor 700 may control the electric implement actuator 540C to adjust a tilt angle of the implement 535 so that the implement 535 contacts a load material (e.g., at a ground surface). As the implement 535 contacts a load material, an external force may be exerted on the electric arm actuator 540B. In some configurations, when the external force exerted on the electric arm actuator 540B exceeds the threshold, the electronic processor 700 may control or allow the electric arm actuator 540B to move in a direction of the force induced on the electric arm actuator 540B as a result of the contact between the implement 535 and the load material. By moving the electric arm actuator 540B in a direction of the external force, the external force exerted on the electric arm actuator 540B may be mitigated (similar to a port-relief valve for a hydraulic system). Further, similar control of the boom actuator 540A (or other actuators) can be implemented in some examples.

As another example, as part of a lift operation while the implement 535 is in contact with a load material, the electronic processor 700 may control the electric boom actuator 540A to adjust a lift position of the boom 530A such that a load material in the implement 535 is lifted. As the electric boom actuator 540A lifts the boom 530A, an external force may be exerted on the electric implement actuator 540C. In some configurations, when the external force exerted on the electric implement actuator 540C exceeds the threshold, the electronic processor 700 may control the electric implement actuator 540C to move in a direction of the force induced on the electric implement actuator 540C from controlling the electric boom actuator 540A to adjust the lift position of the boom 530A. By moving the electric implement actuator 540C in a direction of the external force, the external force exerted on the electric implement actuator 540C may be mitigated (again, similar to a port-relief valve for a hydraulic system).

Alternatively, or in addition, in some configurations, responsive to the force exceeding the threshold (e.g., "Yes" at block 815), the electronic processor 700 may modify operator commands to enforce the force limit. For example, the electronic processor 700 may receive a set of operator commands for performing an operation with the power machine 500. The electronic processor 700 may control the power machine 500 (including, e.g., the workgroup electric actuator(s) 540) to perform the operation. However, when the electronic processor 700 determines that controlling the power machine 500 to perform the operation corresponds to a workgroup electric actuator 540 experiencing an external force that exceeds a corresponding threshold (e.g., "Yes" at block 815), the electronic processor 700 may modify one or more of the operator commands accordingly.

In particular, an operator command for movement of an actuator can be modified so that the external force on the relevant workgroup electric actuator 540 does not exceed the relevant threshold (e.g., is reduced to no longer exceed the threshold). For instance, moving a load at a higher acceleration may result in a greater force than moving the same load at a lower acceleration. Accordingly, as one example, the electronic processor 700 may modify an operator command by reducing an acceleration associated with that operator command, while still preserving the commanded direction and duration of movement. Such a modification, for example, can apply a reduced maximum value and proportionally reduced intermediate values relative to operator inputs (e.g., so that the magnitude of a relevant operator command is effectively reduced by a constant or variable percentage, to provide a corresponding reduction in the associated control signals sent to the relevant actuator(s)). The electronic processor 700 may then continue controlling the power machine 500 to perform the operation in accordance with the modified operator command(s). Accordingly, in some configurations, the electronic processor 700 may reactively enforce a force limit by modifying operator commands, responsive to detecting an external force that exceeds or is approaching a threshold. While various embodiments of the present disclosure are directed to taking some action responsive to a sensed external force exceeding a determined/selected force threshold, consistent with the present disclosure the electronic processor 700 may extrapolate sensed external force data and determine that there is a high likelihood that an increasing force on one or more of the electric actuators will exceed the force threshold shortly (e.g., less than 1 second) and take preemptive action to mitigate the one or more electric actuators from experiencing those determined threshold forces.

As illustrated in FIG. 8, in some configurations, the electronic processor 700 may determine a threshold for the workgroup electric actuator 540 (at block 860). As noted herein, in some instances, the threshold may be specific to a particular one of the workgroup electric actuators 540, in a particular installed or operational configuration. Accordingly, in some configurations, the electronic processor 700 may determine the threshold based on the particular workgroup electric actuator 540, a corresponding work element controlled by the workgroup electric actuator 540, an actuator type or classification of the workgroup electric actuator 540, specifications or characteristics of the specific workgroup electric actuator 540, or the like. For instance, the electronic processor 700 may access threshold data mapping each workgroup electric actuator 540 to a predetermined threshold. Such threshold data may be included in the memory 705 or a remote device accessible by the electronic processor 700.

Alternatively, or in addition, in some configurations, the threshold may be dynamically determined (e.g., as a dynamic threshold). For example, the electronic processor 700 may determine a value for a variable threshold while the power machine 500 is performing an operation (e.g., in real-time or near real-time). In some cases, dynamically determining a threshold may include determining a present relative orientation of different parts of a lift arm or other workgroup assembly, and then calculating (or retrieving) a force threshold for a particular actuator based on the present relative orientation.

In some such cases, for example, a baseline force limit for the actuator can be provided (e.g., a rated maximum force, previously identified and saved in memory). A particular threshold for a present power machine operation can then be determined based on the baseline force limit and the present relative orientation of the workgroup (e.g., to appropriately adjust the baseline force limit in accordance with any changes in mechanical advantage for the present relative orientation, as further discussed below).

In some configurations, the electronic processor 700 may determine the threshold based on a geometric arrangement of a workgroup or workgroup system (or components thereof) of the power machine 500 (e.g., the workgroup system 505 of FIG. 5). In such configurations, the electronic processor 700 may determine an arrangement of a workgroup of the power machine 500 (at block 865), which may be specified by positional information for relevant work elements, including an attitude or pose of the components included in the workgroup system 505 (e.g., the workgroup electric actuators 540, the implement 535, the work elements 530, etc.).

In this regard, a geometric arrangement can in some cases be specified by a set of angular orientations or associated distances that designate a particular orientation of workgroup components relative to each other or relative to another reference frame of a power machine. In some cases, particular (e.g., common) geometric arrangements for lift arms or other workgroups can be pre-specified (e.g., can be stored in encoded form that may not expressly specify each relevant angle or length).

In some cases, the electronic processor 700 may determine the arrangement of the workgroup based on operator commands received for operating the power machine 500 or sensed operation data of the power machine 500. In some instances, the electronic processor 700 may utilize known geometric relationships for the power machine 500 or geometric aspects of the structures of the power machine 500 to determine a present arrangement of the workgroup system 505 (or components therein).

In some configurations, the electronic processor 700 may determine a relevant force threshold based on a mechanical advantage of the workgroup electric actuator 540. For example, the mechanical advantage of a particular workgroup electric actuator 540 relative to movement of the implement 535 (or other reference component) can be known or determined based on a particular geometric arrangement of the workgroup (e.g., of the various lift arm structures discussed above). Using various known geometric characteristics (e.g., known lengths of particular workgroup arms, etc.), the mechanical advantage of a particular actuator for movement of the implement can thus be determined for any given present geometric arrangement of the workgroup. A particular force threshold can then be determined accordingly, e.g., to ensure that amplification of induced force due to a particular mechanical advantage does not result in excessive forces on any given actuator.

In some examples, the electronic processor 700 may determine, based on the data received at block 805, an arrangement of the workgroup system 505 of the power machine 500. Based on the arrangement of the workgroup system 505, the electronic processor 700 may determine, as an actuator-specific threshold, the threshold for the workgroup electric actuator 540 (e.g., accounting for known geometry, any mechanical advantage, etc.).

In some configurations, the electronic processor 700 may monitor the arrangement of the workgroup system 505 for changes. Responsive to detecting changes to the arrangement, the electronic processor 700 may dynamically update the threshold based on the detected changes. For instance, as part of determining an arrangement of the workgroup system 505, the electronic processor 700 may determine angles between various components included in the workgroup system 505 (e.g., an angle between the implement carrier 530C and the arm 530B, an angle between the arm 530B and the boom 530A, etc.) or extension lengths of various actuators. The electronic processor 700 can then determine relevant force thresholds accordingly, and can further determine (e.g., adjust) the thresholds based on detected changes in the one or more angles or extension lengths.

Alternatively, or in addition, in some configurations, the electronic processor 700 may determine the threshold based on a present work task, operation, or operational sequence being performed by the power machine 500. In such configurations, the electronic processor 700 may receive operator commands for the electric power machine and determine a present operation being performed by the power machine 500 based on the operator commands (at block 875). For instance, the electronic processor 700 may determine that the power machine 500 is performing a trenching operation based on the operator commands received. In some configurations, the electronic processor 700 may determine the present operation based on a present geometric arrangement of the workgroup system 505, as described in greater detail herein. In some specific embodiments, an operator may also (temporarily) override a determined force threshold for one of more of the electric actuators 540 of the workgroup system 505 or request an enhanced force threshold where the electronic processor 700 determined force threshold is below a maximum specified force threshold for the electric actuator. In yet further implementations, an operator may request (temporarily) for the power machine 500 to operate or allow for operation of one or more of the electric actuators above the determined force thresholds.

Actuators, consistent with those discussed herein, may be more susceptible to damage associated with the (off-axis) application of external force the further the rod of the actuator extends out of its respective cylinder. Accordingly, in some embodiments consistent with the present disclosure, force thresholds for a given electric actuator may be dynamic (in response to the various inputs disclosed herein) and further with respect to an amount of extension. For example, the electronic processor 700 (all other data inputs being constant) may apply a higher allowable force threshold for the electric actuator where the determined position of the extender 422 is retracted as opposed to where the position is extended. In some specific embodiments, the electronic processor 700 may not adjust the force threshold in response to extension/retraction of the extender 422 until the extender reaches or exceeds 80% or more of its full extension after which the allowable force may be, for example, exponentially decreased between 80-100% of maximum extension. In other implementations, the reduction in allowable force may be linearly reduced between 75-100% of maximum extension.

Various implementations of the present disclosure may be utilized to facilitate enhanced operator comfort. For example, during operation of the power machine 500 an Operator may enable a modality of the workgroup system 505 via the electronic processor 700 that results in the workgroup system 505 absorbing harsh vibrations, swaying and jerking that would otherwise be communicated to the operator compartment or cab 252 of the power machine. In such a modality, the electronic processor 700 in response to receiving data for the power machine 805 including current draw spikes of one or more of the electric actuators 540, associated with momentary surges in a force exerted on the one or more actuators, operates at least momentarily in a force control scheme. In the force control scheme, the one or more of the electric actuators do not energize sufficiently to entirely mitigate extension/retraction of the actuator in response thereto thereby absorbing (at least a portion of the) forces which would otherwise be transferred through the workgroup to the cab and experienced by the operator.

In some instances, the power machine 500 may be performing an operation in which enforcement of a force limit would adversely impact the performance of that operation (e.g., disrupt or prevent completion of that operation, affect the outcome of performing that operation, etc.). In such instances, the electronic processor 700 may determine a force threshold such that performance of an operation is not adversely impacted, at least temporarily (e.g., to enable completion of the operation by the power machine 500). For example, the electronic processor 700 may increase or temporarily override a force limit for a relevant actuator 540 to temporarily allow a greater threshold force (e.g., as induced by external forces) so that the power machine 500 may complete the operation.

In some cases, the electronic processor 700 may temporarily adjust (e.g., increase or override) the threshold for a predetermined period of time. Alternatively, or in addition, the electronic processor 700 may temporarily adjust the threshold until completion of the relevant operation. In some configurations, upon detecting that the operation is completed, the electronic processor 700 may then adjust the threshold, e.g., by reverting the threshold back to a previous threshold, prior to performance of the operation. For example, the electronic processor 700 may adjust the threshold by decreasing the threshold (e.g., enable less external force to be induced on the workgroup electric actuator(s) 540).

In some embodiments, aspects of the disclosed technology, including computerized implementations of methods according to the disclosed technology, can be implemented as a system, method, apparatus, or article of manufacture using standard programming or engineering techniques to produce software, firmware, hardware, or any combination thereof to control a processor device (e.g., a serial or parallel general purpose or specialized processor chip, a single- or multi-core chip, a microprocessor, a field programmable gate array, any variety of combinations of a control unit, arithmetic logic unit, and processor register, and so on), a computer (e.g., a processor device operatively coupled to a memory), or another electronically operated controller to implement aspects detailed herein. Accordingly, for example, embodiments of the disclosed technology can be implemented as a set of instructions, tangibly embodied on a non-transitory computer-readable media, such that a processor device can implement the instructions based upon reading the instructions from the computer-readable media. Some embodiments of the disclosed technology can include (or utilize) a control device such as an automation device, a special purpose or general purpose computer including various computer hardware, software, firmware, and so on, consistent with the discussion below. As specific examples, a control device can include a processor, a microcontroller, a field-programmable gate array, a programmable logic controller, logic gates etc., and other typical components that are known in the art for implementation of appropriate functionality (e.g., memory, communication systems, power sources, user interfaces and other inputs, etc.).

The term "article of manufacture" as used herein is intended to encompass a computer program accessible from any computer-readable device, carrier (e.g., non-transitory signals), or media (e.g., non-transitory media). For example, computer-readable media can include but are not limited to magnetic storage devices (e.g., hard disk, floppy disk, magnetic strips, and so on), optical disks (e.g., compact disk (CD), digital versatile disk (DVD), and so on), smart cards, and flash memory devices (e.g., card, stick, and so on). Additionally, it should be appreciated that a carrier wave can be employed to carry computer-readable electronic data such as those used in transmitting and receiving electronic mail or in accessing a network such as the Internet or a local area network (LAN). Those skilled in the art will recognize that many modifications may be made to these configurations without departing from the scope or spirit of the claimed subject matter.

Certain operations of methods according to the disclosed technology, or of systems executing those methods, may be represented schematically in the FIGS. or otherwise discussed herein. Unless otherwise specified or limited, representation in the FIGS. of particular operations in particular spatial order may not necessarily require those operations to be executed in a particular sequence corresponding to the particular spatial order. Correspondingly, certain operations represented in the FIGS., or otherwise disclosed herein, can be executed in different orders than are expressly illustrated or described, as appropriate for particular embodiments of the disclosed technology. Further, in some embodiments, certain operations can be executed in parallel, including by dedicated parallel processing devices, or separate computing devices configured to interoperate as part of a large system.

As used herein in the context of computer implementation, unless otherwise specified or limited, the terms "component," "system," "module," "block," and the like are intended to encompass part or all of computer-related systems that include hardware, software, a combination of hardware and software, or software in execution. For example, a component may be, but is not limited to being, a processor device, a process being executed (or executable) by a processor device, an object, an executable, a thread of execution, a computer program, or a computer. By way of illustration, both an application running on a computer and the computer can be a component. One or more components (or system, module, and so on) may reside within a process or thread of execution, may be localized on one computer, may be distributed between two or more computers or other processor devices, or may be included within another component (or system, module, and so on).

Also as used herein, unless otherwise limited or defined, "or" indicates a non-exclusive list of components or operations that can be present in any variety of combinations, rather than an exclusive list of components that can be present only as alternatives to each other. For example, a list of "A, B, or C" indicates options of: A; B; C; A and B; A and C; B and C; and A, B, and C. Correspondingly, the term "or" as used herein is intended to indicate exclusive alternatives only when preceded by terms of exclusivity, such as "either," "one of," "only one of," or "exactly one of." Further, a list preceded by "one or more" (and variations thereon) and including "or" to separate listed elements indicates options of one or more of any or all of the listed elements. For example, the phrases "one or more of A, B, or C" and "at least one of A, B, or C" indicate options of: one or more A; one or more B; one or more C; one or more A and one or more B; one or more B and one or more C; one or more A and one or more C; and one or more of each of A, B, and C. Similarly, a list preceded by "a plurality of" (and variations thereon) and including "or" to separate listed elements indicates options of multiple instances of any or all of the listed elements. For example, the phrases "a plurality of A, B, or C" and "two or more of A, B, or C" indicate options of: A and B; B and C; A and C; and A, B, and C. In general, the term "or" as used herein only indicates exclusive alternatives (e.g. "one or the other but not both") when preceded by terms of exclusivity, such as "either," "one of," "only one of," or "exactly one of."

Also as used herein, unless otherwise specified or limited, the terms "about" and "approximately" as used herein with respect to a reference value refer to variations from the reference value of ±20% or less (e.g., ±15, ±10%, ±5%, etc.), inclusive of the endpoints of the range. Similarly, as used herein with respect to a reference value, the term "substantially equal" (and the like) refers to variations from the reference value of less than ±5% (e.g., ±2%, ±1%, ±0.5%) inclusive. Where specified in particular, "substantially" can indicate a variation in one numerical direction relative to a reference value. For example, the term "substantially less" than a reference value (and the like) indicates a value that is reduced from the reference value by 30% or more (e.g., 35%, 40%, 50%, 65%, 80%), and the term "substantially more" than a reference value (and the like) indicates a value that is increased from the reference value by 30% or more (e.g., 35%, 40%, 50%, 65%, 80%).

Also as used herein, unless otherwise limited or defined, "current" is generally used as a temporal measure, i.e., to indicate a present value (e.g., a present position, load, etc.).

In contrast, "electric current" is used to refer to the flow of electric charge in electric systems.

Although the present technology has been described by referring to preferred embodiments, workers skilled in the art will recognize that changes may be made in form and detail without departing from the scope of the discussion.

What is claimed is:

1. A control system of an electric power machine, the control system comprising:

one or more electronic processors in electrical communication with a plurality of electric actuators of the electric power machine and configured to:

control a first electric actuator of the plurality of electric actuators to perform an operation according to a set of operator commands;

receive data for the electric power machine while the electric power machine is performing the operation;

determine, based on the data, a present electric current of a second electric actuator of the plurality of electric actuators;

detect, based on the present electric current, when a force on the second electric actuator exceeds a threshold; and responsive to the force exceeding the threshold, control the first electric actuator or the second electric actuator to reduce the force on the second electric actuator resulting from the first electric actuator performing the operation.

2. The control system of claim 1, wherein the one or more electronic processors control the second electric actuator to reduce the force.

3. The control system of claim 1, wherein the second electric actuator is an electric lift actuator of a lift arm assembly of the electric power machine and the first electric actuator is an electric tilt actuator for an implement of the electric power machine.

4. The control system of claim 3, wherein the one or more electronic processors are configured to:

control the first electric actuator to adjust a tilt angle of the implement; and while controlling the first electric actuator to adjust the tilt angle of the implement, control the second electric actuator to move in a direction of the force induced on the second electric actuator by the first electric actuator adjusting the tilt angle of the implement.

5. The control system of claim 1, wherein the second electric actuator is an electric tilt actuator for an implement of the electric power machine and the first electric actuator is an electric lift actuator of a lift arm assembly of the electric power machine.

6. The control system of claim 5, wherein the one or more electronic processors are configured to:

control the first electric actuator to adjust a lift position of the lift arm assembly; and while controlling the first electric actuator to adjust the lift position of the lift arm assembly, control the second electric actuator to move in a direction of the force induced on the second electric actuator from controlling the first electric actuator to adjust the lift position of the lift arm assembly.

7. The control system of claim 1, wherein the one or more electronic processors are configured to:

determine, based on the data, a geometric arrangement of a workgroup of the electric power machine, the workgroup including the plurality of electric actuators; and determine, based on the geometric arrangement, a first threshold for the first electric actuator and a second threshold for the second electric actuator of the plurality of electric actuators.

8. A method for controlling an electric power machine, the method comprising:

receiving, with one or more electronic processors in electrical communication with electric actuators of the electric power machine, data for the electric power machine while the electric power machine is operating;

determining, with the one or more electronic processors, based on the data, a force on a first electric actuator of the electric actuators, the force corresponding to a present or commanded operation with at least one of the electric actuators;

determining, with the one or more electronic processors, when the force exceeds a force threshold; and responsive to the force exceeding the force threshold, controlling, with the one or more electronic processors, one or more of the electric actuators to provide an updated force on the first electric actuator that does not exceed the force threshold.

9. The method of claim 8, wherein providing, with the one or more electronic processors, the updated force, as part of controlling the one or more of the electric actuators, includes one or more of:

controlling the first electric actuator to move in a direction of the force; or controlling a second electric actuator of the electric actuators to change an induced force on the first electric actuator.

10. The method of claim 8, further comprising:

determining, with the one or more electronic processors, the force on the first electric actuator while a brake of the first electric actuator is engaged;

providing, with the one or more electronic processors, the updated force by disengaging the brake and commanding, for the first electric actuator, a response force opposing a direction of the force.

11. The method of claim 8, wherein the data received for the electric power machine includes at least one of: workgroup geometry information, a set of operator control signals, induced force information, or electric current information to the first electric actuator.

12. The method of claim 8, further comprising:

determining, with the one or more electronic processors, based on the data, an arrangement of a workgroup of the electric power machine; and determining, with the one or more electronic processors, the force threshold for the first electric actuator based on the arrangement of the workgroup of the electric power machine.

13. The method of claim 12, wherein the force threshold dynamically changes responsive to changes to the arrangement of the workgroup.

14. The method of claim 12, wherein determining, with the one or more electronic processors, the force threshold for the first electric actuator includes determining the force threshold for the first electric actuator based on a mechanical advantage of the first electric actuator relative to movement of an implement of the electric power machine.

15. The method of claim 12, further comprising:

determining, with the one or more electronic processors, a plurality of angles for a workgroup of the electric power machine, wherein each angle of the plurality of angles is between a corresponding set of two components included in the workgroup of the electric power machine; and adjusting, with the one or more electronic processors, the force threshold for the first electric actuator based on the plurality of angles.

16. The method of claim 8, further comprising:

receiving, with the one or more electronic processors, a sequence of operator commands associated with performance of a work task with the electric power machine; and in response to the sequence of operator commands corresponding to a force on the first electric actuator that exceeds the force threshold, increasing or overriding, with the one or more electronic processors, the force threshold to enable completion of the work task.

17. The method of claim 16, further comprising:

detecting, with the one or more electronic processors, completion of the work task; and responsive to completion of the work task, decreasing or reinstating, with the one or more electronic processors, the force threshold.

18. The method of claim 8, wherein the first electric actuator is one of an electric lift actuator of a lift arm assembly of the electric power machine or an electric tilt actuator for an implement of the electric power machine.

19. The method of claim 8, wherein the electric power machine is an electric excavator that includes an excavator lift arm structure; and wherein the first electric actuator is a lift arm actuator of the excavator lift arm structure.

* * * * *